US010137682B2

(12) United States Patent
Fukuda

(10) Patent No.: US 10,137,682 B2
(45) Date of Patent: Nov. 27, 2018

(54) LIQUID EJECTING HEAD AND LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/805,551

(22) Filed: Nov. 7, 2017

(65) Prior Publication Data

US 2018/0134034 A1 May 17, 2018

(30) Foreign Application Priority Data

Nov. 15, 2016 (JP) ..... 2016-222131

(51) Int. Cl.
*B41J 2/045* (2006.01)
*B41J 2/14* (2006.01)

(52) U.S. Cl.
CPC ..... *B41J 2/04541* (2013.01); *B41J 2/0455* (2013.01); *B41J 2/04581* (2013.01); *B41J 2/14201* (2013.01); *B41J 2/14233* (2013.01); *B41J 2002/14362* (2013.01); *B41J 2002/14419* (2013.01); *B41J 2002/14491* (2013.01)

(58) Field of Classification Search
CPC .... B41J 2002/14362; B41J 2002/14419; B41J 2002/14491; B41J 2/14233; B41J 2/04541; B41J 2/04581; B41J 2/0455
See application file for complete search history.

(56) References Cited

U.S. PATENT DOCUMENTS 6,652,053 B2 * 11/2003 Imanaka ..... B41J 2/0451 347/19
6,827,413 B1 * 12/2004 Kawatoko ..... B41J 2/04506 347/14
2011/0175956 A1 * 7/2011 Tsukamoto ..... B41J 2/04581 347/10

FOREIGN PATENT DOCUMENTS

JP 2014-008633 A 1/2014

* cited by examiner

*Primary Examiner* — Lamson Nguyen
(74) *Attorney, Agent, or Firm* — Workman Nydegger

(57) ABSTRACT

A liquid ejecting head includes a pressure chamber; a nozzle communicating with the pressure chamber; a piezoelectric element which generates pressure fluctuations in a liquid in the pressure chamber; and a driving IC which is connected to the piezoelectric element through wiring and which carries out driving control of the piezoelectric element, in which the driving control has a first preliminary heating step of heating the liquid in the pressure chamber, a preliminary ejection step of ejecting a liquid in the pressure chamber from the nozzle after the first preliminary heating step, a second preliminary heating step of heating the liquid in the pressure chamber more weakly than in the first preliminary heating step after the preliminary ejection step, and a main ejection step of starting an operation of ejecting the liquid from the nozzle after the second preliminary heating step.

20 Claims, 14 Drawing Sheets

LIQUID EJECTING HEAD AND LIQUID EJECTING APPARATUS

The entire disclosure of Japanese Patent Application No. 2016-222131, filed Nov. 15, 2016 is expressly incorporated by reference herein.

BACKGROUND

1. Technical Field

The present invention relates to a liquid ejecting head for ejecting liquid in a pressure chamber from a nozzle, and a liquid ejecting apparatus.

2. Related Art

As a liquid ejecting apparatus on which a liquid ejecting head is mounted, for example, there is an image recording apparatus such as an ink jet printer or an ink jet plotter; however, recently, liquid ejecting heads have also been applied to various kinds of manufacturing apparatuses, taking advantage of the ability to accurately deposit a very small amount of liquid at a predetermined position. For example, liquid ejecting heads are applied to display manufacturing apparatuses for manufacturing a color filter such as a liquid crystal display, electrode forming apparatuses for forming electrodes such as organic electroluminescence (EL) displays and field emission displays (FED), and chip manufacturing apparatuses for manufacturing biochips (biochemical elements). A recording head for the image recording apparatus ejects liquid ink and a color material ejecting head for a display manufacturing apparatus ejects solutions of R (Red), G (Green), and B (Blue) color materials. In addition, an electrode material ejecting head for the electrode forming apparatus ejects a liquid electrode material and a bioorganic material ejecting head for the chip manufacturing apparatus ejects a solution of bioorganic material.

The liquid ejecting heads described above are, for example, provided with a nozzle plate in which a plurality of nozzles are formed, a pressure chamber-forming substrate in which a plurality of spaces serving as pressure chambers communicating with the nozzles are formed, a piezoelectric element for causing pressure fluctuations in the liquid in the pressure chamber, or the like. In addition, as a liquid ejecting head, there is a liquid ejecting head provided with a temperature detection element for detecting the temperature of a liquid in a pressure chamber, and a driving IC for driving the piezoelectric element (refer to JP-A-2014-8633). Then, the liquid ejecting head in JP-A-2014-8633 is formed such that, after a liquid in a pressure chamber is heated using heat generated by a piezoelectric element or the like and idle ejection for ejecting the liquid from the nozzle outside the printing region is performed in this state, a printing operation (print operation) is performed when the temperature of the liquid in the pressure chamber reaches a predetermined temperature suitable for printing. As a result, it is possible to return from a state in which the liquid in the pressure chamber is thickened, a state in which the meniscus in the nozzle is dried, or the like to a state of normal liquid ejection.

However, in the configuration disclosed in JP-A-2014-8633, since it is necessary to provide a temperature detection element for detecting whether or not the temperature of the liquid in the pressure chamber has reached a predetermined temperature suitable for printing after performing idle ejection, the configuration of the liquid ejecting head is complex. In addition, in a case where it is not possible to accurately detect the temperature of the liquid in the pressure chamber with a temperature detection means, there is a concern that it will not be possible to determine whether or not the pressure chamber is in a state in which normal liquid ejection is possible.

SUMMARY

An advantage of some aspects of the invention is to provide a liquid ejecting head capable of shifting to a state in which normal liquid ejection is possible with a simpler configuration, and a liquid ejecting apparatus.

According to an aspect of the invention, there is provided a liquid ejecting head including a pressure chamber-forming substrate provided with a pressure chamber, a nozzle communicating with the pressure chamber, a piezoelectric element which is provided in a vibrating plate closing a portion of the pressure chamber and which generates pressure fluctuations in a liquid in the pressure chamber by causing the vibrating plate to vibrate, and a driving IC which is connected to the piezoelectric element through wiring and which carries out driving control of the piezoelectric element, in which the driving control has a first preliminary heating step of heating the liquid in the pressure chamber by causing at least any one of the piezoelectric element, the driving IC, and the wiring to generate heat, a preliminary ejection step of ejecting the liquid in the pressure chamber from the nozzle after the first preliminary heating step, a second preliminary heating step of heating the liquid in the pressure chamber more weakly than in the first preliminary heating step by causing at least any one of the piezoelectric element, the driving IC, and the wiring to generate heat after the preliminary ejection step, and a main ejection step of starting an operation of ejecting the liquid from the nozzle after the second preliminary heating step.

According to this configuration, in the first preliminary heating step, since it is possible to heat the liquid in the pressure chamber to lower the viscosity of the liquid, it is easy to eject liquid from the nozzle in the preliminary ejection step. As a result, it is possible to discharge a solidified liquid, a thickened liquid, or the like and to refresh the nozzle. In addition, once the temperature of the liquid in the pressure chamber is brought close to the ambient temperature by ejecting the liquid in the preliminary ejection step, it is also possible to set the temperature of the liquid in the pressure chamber to a predetermined temperature suitable for a printing operation or the like by heating the liquid in the pressure chamber in the second preliminary heating step without using the result of temperature detection by a temperature detection means which detects the temperature of the liquid in the pressure chamber. That is, when the liquid in the pressure chamber warmed in the first preliminary heating step is cooled by the ejection of the liquid in the preliminary ejection step, it is sufficient to eject the liquid until the liquid in the pressure chamber approaches the ambient temperature, thus there is no need to accurately determine the temperature of the liquid in the pressure chamber. As a result, even in a case where it is not possible to accurately determine the temperature detection by the temperature detection means, since the liquid is ejected at a predetermined temperature suitable for operations such as printing, it is possible to suppress deterioration of the image quality formed on the depositing target. As a result, it is possible to increase the reliability of the liquid ejecting head. Furthermore, for example, it is also possible to eliminate the temperature detection means for detecting the temperature of the liquid in the pressure chamber, and it is possible to simplify the configuration of the liquid ejecting head.

In addition, in the above configuration, it is desirable that, in at least one step of the first preliminary heating step or the second preliminary heating step, a driving voltage waveform which causes pressure fluctuations in the liquid in the pressure chamber to such an extent that liquid is not ejected from the nozzle be applied to the piezoelectric element to cause at least any one of the piezoelectric element, the driving IC, and the wiring to generate heat.

According to this configuration, since the piezoelectric element is driven by the application of the driving voltage waveform and pressure fluctuations are generated in the liquid in the pressure chamber, it is possible to stir the liquid in the pressure chamber. As a result, in the preliminary ejection step, liquid is more easily ejected from the nozzle and thickened liquid or the like is more easily discharged.

Furthermore, it is desirable that the configuration described above be provided with a plurality of the pressure chambers, the nozzles, and the piezoelectric elements, in which, in at least one step of the first preliminary heating step or the second preliminary heating step, the driving IC applies the driving voltage waveform to at least one of the piezoelectric elements.

According to this configuration, each of the piezoelectric element, the driving IC, and the wiring easily generates heat, and the heating efficiency of the liquid in the pressure chamber is improved.

In addition, in any one of the configurations described above, it is desirable that, in the second preliminary heating step, the driving voltage waveform applied to the piezoelectric element be the same as the driving voltage waveform applied to the piezoelectric element corresponding to the nozzle from which the liquid is not ejected in the main ejection step.

According to this configuration, a separate circuit for generating a driving voltage waveform is not necessary, and the configuration of the liquid ejecting head is simplified. In addition, switching of the driving voltage waveform becomes unnecessary, and it is possible to shorten the shift from the second preliminary heating step to the main ejection step.

Furthermore, in any one of each configuration described above, it is desirable that the driving IC overlap with at least a portion of the pressure chamber in a stacking direction of the pressure chamber-forming substrate and the piezoelectric element.

According to this configuration, it is possible to efficiently transmit the heat of the driving IC to the liquid in the pressure chamber. As a result, it is possible to suppress the power consumption of the driving IC and hence the liquid ejecting head.

In addition, it is desirable that each configuration described above include a reservoir in which a liquid is stored, in which the reservoir and the pressure chamber communicate with each other via a communication port.

According to this configuration, in the first preliminary heating step, even if the liquid in the pressure chamber is stirred by generating pressure fluctuations in the liquid in the pressure chamber, it is possible to suppress the solidified liquid, the thickened liquid, or the like from reaching the reservoir. As a result, it is possible to suppress the ejection amount of the liquid in the preliminary ejection step.

Furthermore, it is desirable that any one of each configuration described above include a plurality of the pressure chambers, the nozzles, and the piezoelectric elements, a plurality of pressure chamber groups provided with a plurality of the pressure chambers arranged linearly, in which the driving IC is arranged over a position overlapping with at least a portion of another pressure chamber group in the stacking direction from a position overlapping at least a portion of one pressure chamber group in a stacking direction of the pressure chamber-forming substrate and the piezoelectric element.

According to this configuration, it is possible to suppress variations in the temperature of the liquid in one pressure chamber group and the temperature of the liquid in the other pressure chamber groups. As a result, it is possible to suppress variations in the ejection characteristics of the liquid ejected from the nozzles corresponding to one pressure chamber group and the ejection characteristics of the liquid ejected from the nozzles corresponding to the other pressure chamber groups.

In addition, it is desirable that any one of each configuration described above include a plurality of the pressure chambers, the nozzles, and the piezoelectric elements, in which, in the first preliminary heating step, the preliminary ejection step, and the second preliminary heating step, the same driving voltage waveform is applied to the piezoelectric elements corresponding to the nozzles which eject the same type of liquid among the plurality of piezoelectric elements.

According to this configuration, since it is possible to easily set the temperatures of each pressure chamber to which the same type of liquid is supplied to substantially the same temperature, it is possible to suppress variations in ejection characteristics between nozzles ejecting the same type of liquid.

Furthermore, it is desirable that any one of each configuration described above include a plurality of the pressure chambers, the nozzles, the piezoelectric elements, and reservoirs communicating with the plurality of the pressure chambers, in which, in a plurality of pressure chambers communicating with the same reservoir among the plurality of pressure chambers, liquid amounts ejected from the corresponding nozzles are set in the respective preliminary ejection steps.

According to this configuration, since the temperatures of each pressure chambers communicating with the same reservoir are easily set to substantially the same temperature, it is possible to suppress variations in ejection characteristics between the nozzles communicating with the same reservoir.

In addition, it is desirable that in any one of each configuration described above, the driving IC be provided with a switching circuit, and the driving IC be caused to generate heat by switching the switching circuit on and off in at least one step of the first preliminary heating step or the second preliminary heating step.

According to this configuration, it is possible to heat the liquid in the pressure chamber without driving the piezoelectric element. As a result, it is possible to suppress power consumption of the liquid ejecting head.

In addition, it is desirable that any one of each configuration described above include an operation mode carrying out a third preliminary heating step of heating the liquid in the pressure chamber by causing at least any one of the piezoelectric element, the driving IC, and the wiring to generate heat under conditions in which the first preliminary heating step and the preliminary ejection step are not carried out and liquid is not ejected from the nozzle, and a main ejection step of starting an operation which ejects the liquid from the nozzles after the third preliminary heating step.

According to this configuration, it is possible to suppress the consumption of liquid since it is possible to perform the main ejection step without carrying out the preliminary ejection step in cases such as where no foreign matter or air bubbles are mixed in the liquid in the nozzle or the pressure chamber or where the liquid in the nozzle or the pressure chamber is not thickened. In addition, since the first preliminary heating step and the preliminary ejection step are not performed, it is possible to shorten the time required for completing the operations such as printing (that is, the main ejection step).

According to another aspect of the invention, there is provided a liquid ejecting apparatus including the liquid ejecting head according to any one of the configurations described above.

According to this configuration, it is possible to increase the reliability of the liquid ejecting apparatus.

BRIEF DESCRIPTION OF THE DRAWINGS

The invention will be described with reference to the accompanying drawings, wherein like numbers reference like elements.

FIG. 4 is a waveform diagram illustrating a configuration of a driving signal used in a preliminary ejection step or the like.

FIG. 5 is a waveform diagram illustrating a configuration of a driving signal used in a preliminary heating step or the like.

DESCRIPTION OF EXEMPLARY EMBODIMENTS

Figure 1:
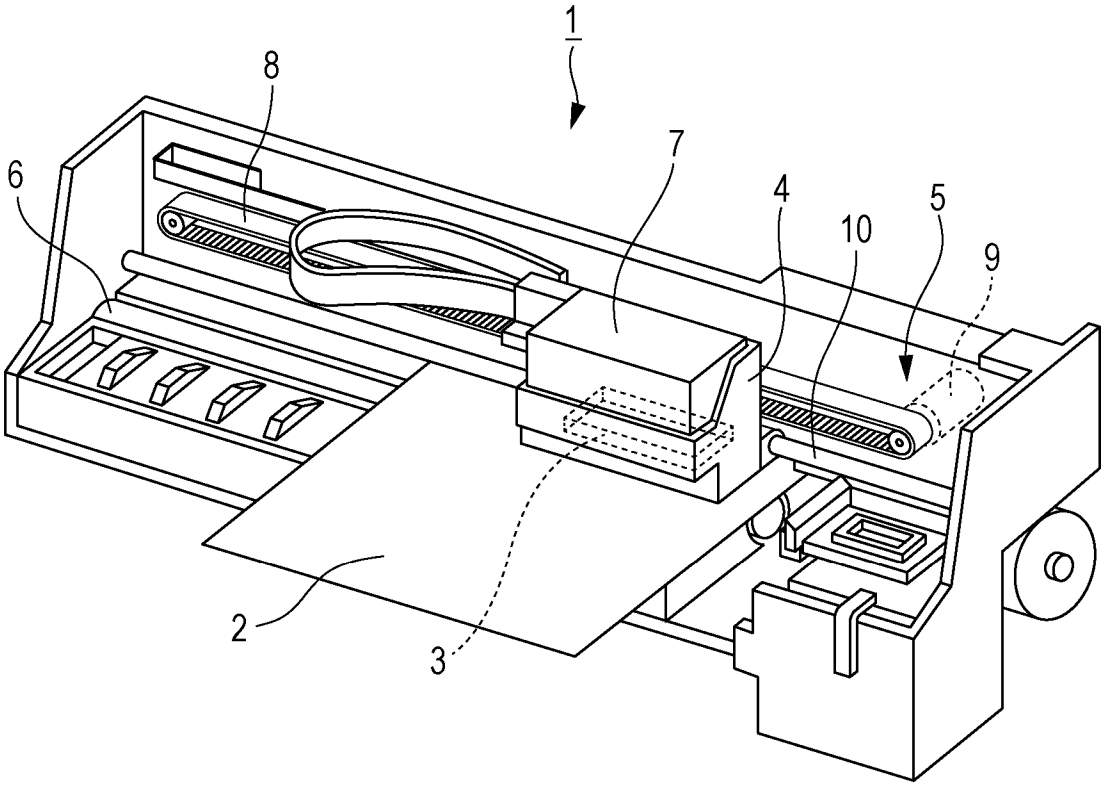
FIG. 1 is a perspective view illustrating a configuration of a printer.
Figure 2:
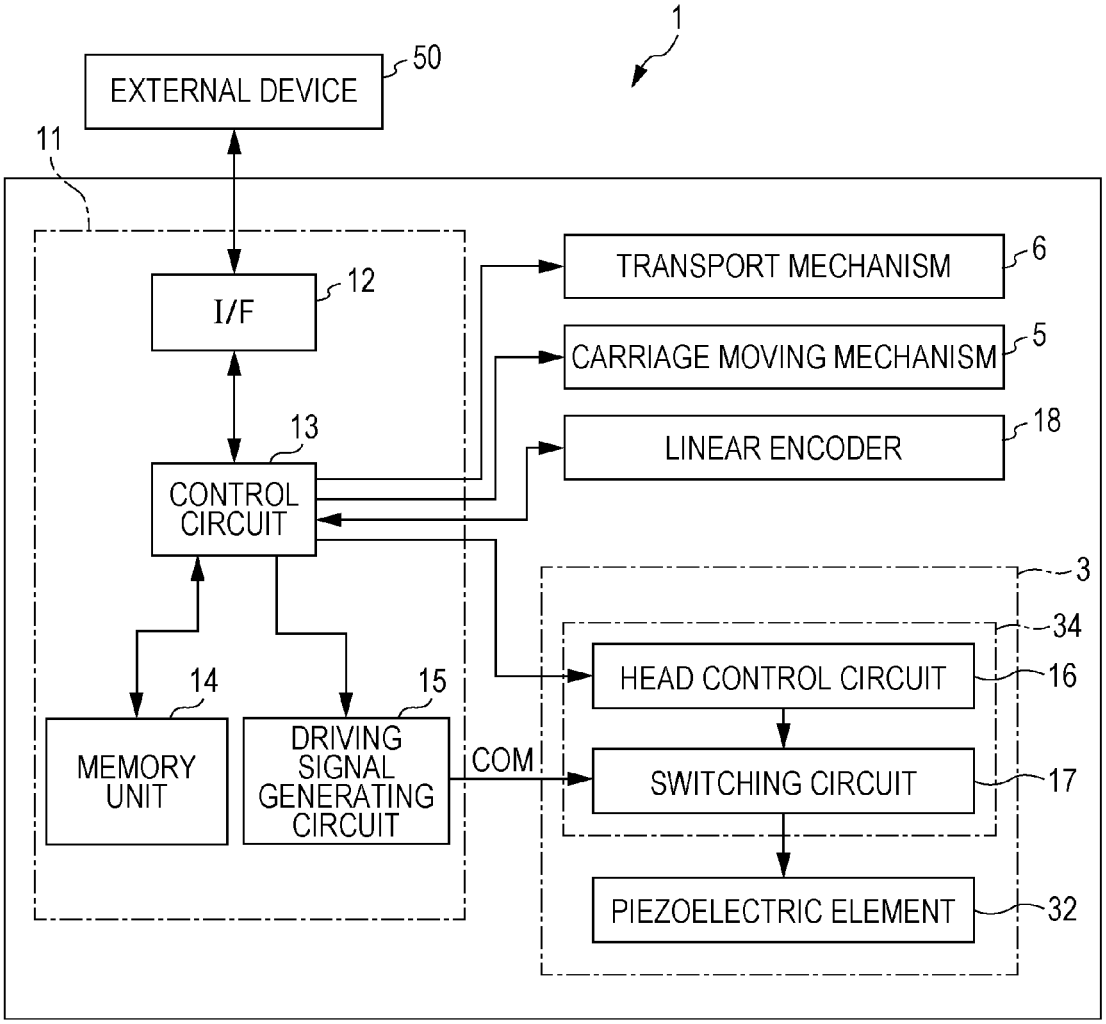
FIG. 2 is a block diagram illustrating an electrical configuration of a printer.

Embodiments for realizing the invention will be described below with reference to the accompanying drawings. In the following embodiments, various restrictions are made as preferable specific examples of the invention, but unless it is particularly stated that the scope of the invention is limited to the following description, the invention is not limited to these embodiments. In addition, in the following description, an ink jet recording head (referred to below as a recording head) 3, which is one type of liquid ejecting head, will be described as an example. FIG. 1 is a perspective view of an ink jet printer (referred to below as a printer) 1 which is a type of liquid ejecting apparatus on which a recording head 3 is mounted. FIG. 2 is a block diagram illustrating the electrical configuration of the printer 1.

The printer 1 is an apparatus which ejects ink (a type of liquid) onto the surface of a recording medium 2 (a type of depositing target) such as recording paper to record an image or the like. As shown in FIG. 1, the printer 1 is provided with a recording head 3, a carriage 4 on which the recording head 3 is mounted, a carriage moving mechanism 5 for moving the carriage 4 in the main scanning direction, a transport mechanism 6 which transports a recording medium 2 in a sub-scanning direction, and the like. The ink described above is stored in the ink cartridge 7 as a liquid supply source. The ink cartridge 7 is detachably attached to the recording head 3. It is also possible to adopt a configuration in which the ink cartridge is arranged on the main body side of the printer and supplied from the ink cartridge to the recording head through an ink supply tube. In addition, as the recording medium, it is possible to adopt various media such as paper, fiber, cloth, leather, metal, plastic, glass, wood, ceramics, and the like.

The carriage moving mechanism 5 is provided with a timing belt 8. The timing belt 8 is driven by a pulse motor 9 such as a DC motor. Therefore, when the pulse motor 9 is operated, the carriage 4 is guided by a guide rod 10 installed in the printer 1 and reciprocates in the main scanning direction (the width direction of the recording medium 2). The position of the carriage 4 in the main scanning direction is detected by a linear encoder 18 (refer to FIG. 2) which is one type of position information detection means. The linear encoder 18 transmits the detection signal, that is, the encoder pulse (a type of position information) to the control circuit 13 of the printer 1.

Next, description will be given of an electrical configuration of the printer 1. As shown in FIG. 2, in the printer 1 according to the present embodiment, each portion is controlled by the printer controller 11. The printer controller 11 in the present embodiment has an interface (I/F) unit 12, a control circuit 13, a memory unit 14, and a driving signal generating circuit 15. The interface unit 12 receives printing data and printing commands from an external device 50 such as a computer or a portable information terminal and outputs the status information of the printer 1 to the external device 50 side. The memory unit 14 is an element for storing a program for the control circuit 13 and data used for various controls and includes ROM, RAM, non-volatile random access memory (NVRAM), and the like.

The control circuit 13 controls each unit according to the program stored in the memory unit 14. In addition, the control circuit 13 in the present embodiment generates ejection data indicating the time and the nozzle 26 of the recording head 3 from which to eject ink at the time of the printing operation based on printing data including information for forming an image or the like on the recording medium 2 sent from the external device 50, and the control circuit 13 transmits the ejection data to the head control circuit 16 of the recording head 3. In addition, a timing pulse PTS is generated from the encoder pulses output from the linear encoder 18. Then, the control circuit 13 controls the transfer of printing data in synchronization with the timing pulse PTS, the generation of a driving signal by the driving signal generating circuit 15, and the like. In addition, the control circuit 13 generates a timing signal such as a latch signal LAT and outputs the signal to the head control circuit 16. The driving signal generating circuit 15 generates an analog signal based on the waveform data relating to the waveform of the driving signal and amplifies the signal to generate a driving signal COM.

In addition, the printer 1 in the present embodiment is provided with a transport mechanism 6, a carriage moving mechanism 5, a linear encoder 18, a recording head 3, and the like. A driving IC 34 provided with a head control circuit 16 and a switching circuit 17 is mounted in the recording head 3. That is, the head control circuit 16 and the switching circuit 17 are circuits in the driving IC 34 mounted on the recording head 3. The head control circuit 16 is formed of a shift register, a latch circuit, a decoder, and the like and outputs a selection signal SW to the switching circuit 17 based on the ejection data and the timing signal. A switching circuit 17 is provided for each piezoelectric element 32 and controls the supply of the driving signal COM to the piezoelectric element 32 based on the selection signal SW. For example, in a case where the selection signal SW is at a high level which is higher than the predetermined voltage threshold value, the switching circuit 17 is switched on and the driving signal COM is supplied to the piezoelectric element 32. On the other hand, in a case where the selection signal SW is at a low-level which is lower than the predetermined voltage threshold value, the switching circuit 17 is switched off and the driving signal COM is not supplied to the piezoelectric element 32. A detailed description will be given of the configuration of the switching circuit 17 below. In addition, the driving IC 34 is not limited to the above-described driving IC, but may be provided with a portion or all of the control circuit, a portion or all of the memory unit, a portion or all of the driving signal generating circuit, or the like. That is, it is also possible to adopt a configuration in which the driving IC is provided with the functions of a portion or all of the printer controller.

Figure 3:
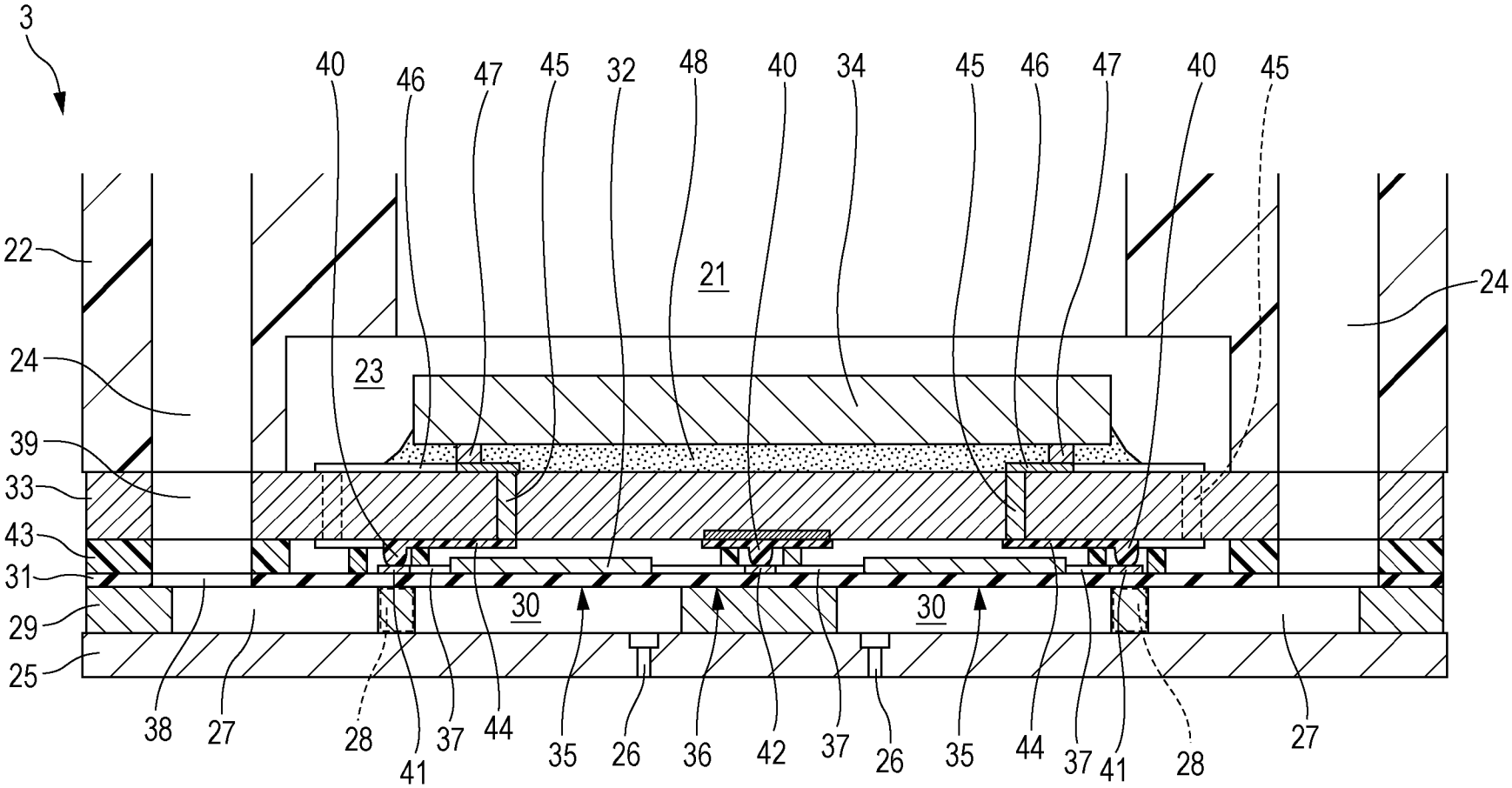
FIG. 3 is a cross-sectional view illustrating a configuration of a recording head.

Next, description will be given of the recording head 3. FIG. 3 is a cross-sectional view illustrating the configuration of the recording head 3. In the following description, the stacking direction of each member is described as the vertical direction for convenience. As shown in FIG. 3, the recording head 3 in the present embodiment is formed by stacking the driving IC 34, the sealing plate 33, the pressure chamber-forming substrate 29, the nozzle plate 25, and the like and attaching these components to the head case 22 in a unitized state.

The head case 22 is a box-shaped member formed of a synthetic resin, and a liquid introduction path 24 for supplying ink to each pressure chamber 30 is formed in the head case 22. The liquid introduction path 24 is a space in which ink common to a reservoir 27 to be described below and a plurality of formed pressure chambers 30 is stored. In the present embodiment, two liquid introduction paths 24 (two rows) corresponding to the rows of pressure chambers 30 arranged in two parallel rows are formed. In addition, in a portion on the lower side (the side of the nozzle plate 25) of the head case 22, a rectangular recessed accommodating space 23 is formed from the lower surface (the surface on the side of the nozzle plate 25) of the head case 22 to the middle in the height direction of the head case 22. The driving IC 34 stacked on the sealing plate 33 is configured to be accommodated in the accommodating space 23 when the sealing plate 33 described below is bonded in a state of being positioned on the lower surface of the head case 22. Furthermore, a case opening 21 which enables communication between the space outside the head case 22 and the accommodating space 23 is formed in a portion of the ceiling surface of the accommodating space 23 (specifically, a portion corresponding to the driving IC 34 described below). Therefore, in the present embodiment, the driving IC 34 is in a state of being exposed to the case opening 21. A wiring substrate such as a flexible printed circuit (FPC) (not shown) is inserted through the case opening 21 into the accommodating space 23, and a terminal portion thereof is connected to the driving IC 34 or the sealing plate 33.

The pressure chamber-forming substrate 29 is formed of a silicon substrate (for example, a silicon single crystal substrate with (110) crystal plane orientation) in which a space to form the reservoir 27, the communication port 28 and the pressure chamber 30 is formed. In these spaces, for example, a portion of the pressure chamber-forming substrate 29 is completely removed in the substrate thickness direction by anisotropic etching. In these spaces, the opening on the lower surface side is sealed by the nozzle plate 25, and the opening on the upper surface side is sealed by the vibrating plate 31 to become the reservoir 27, the communication port 28, and the pressure chamber 30. A plurality of pressure chambers 30 corresponding to the plurality of nozzles 26 in the nozzle row direction are formed. In addition, the rows of the pressure chambers 30 (corresponding to the pressure chamber group in the invention) linearly arranged in the nozzle row direction are formed in two rows corresponding to the nozzle rows formed in two rows. The reservoir 27 is a space in which ink common to the plurality of pressure chambers 30 is stored and is formed to be elongated in the nozzle row direction. The reservoir 27 in the present embodiment is formed in two rows corresponding to the rows of pressure chambers 30 formed in two rows. Specifically, the reservoir 27 is formed at a position outside the row of the one pressure chamber 30 and at a position outside the row of the other pressure chamber 30. The communication port 28 is a flow path which enables communication between the individual pressure chambers 30 and the reservoir 27. The communication port 28 is formed to have a narrower width (the dimension in the nozzle row direction) than the width of the pressure chamber 30 and imparts a constant flow path resistance to the ink passing through the communication port 28.

The nozzle plate 25 bonded to the lower surface (the surface opposite to the sealing plate 33 side) of the pressure chamber-forming substrate 29 is a substrate made of a silicon having substantially the same size as the outer shape of the pressure chamber-forming substrate 29. In this nozzle plate 25, a plurality of nozzles 26 are formed linearly (in a row). Two rows of nozzles 26 (that is, nozzle rows) formed of a plurality of the nozzles 26 are formed in the nozzle plate 25. The nozzles 26 forming each nozzle row are provided at a pitch corresponding to the dot formation density from the nozzle 26 on one end to the nozzle 26 on the other end, for example, at equal intervals in the sub-scanning direction. In addition, the nozzle 26 is formed at a position corresponding to the end of the pressure chamber 30 on the side opposite to the communication port 28 side in the direction orthogonal to the nozzle row (that is, the longitudinal direction of the pressure chamber 30). That is, the nozzle 26 communicates with the pressure chamber 30 at the end on the side opposite to the communication port 28 side in the longitudinal direction. It is also possible for the nozzle plate to be bonded to an inside region separated from the reservoir in the pressure chamber-forming substrate and for the opening on the lower surface side of the space forming the reservoir to be sealed with a member such as a flexible compliance sheet, for example.

The vibrating plate 31 stacked on the upper surface (the surface on the side opposite to the nozzle plate 25 side) of the pressure chamber-forming substrate 29 is an elastic thin film member. The vibrating plate 31 seals (closes) an upper opening such as a space for forming the pressure chamber 30. In other words, the pressure chamber 30 and the like are partitioned by the vibrating plate 31. A portion of the vibrating plate 31 corresponding to the pressure chamber 30 (more specifically, the upper opening of the pressure chamber 30) functions as a displacement portion which is displaced in a direction away from or toward the nozzle 26 in accordance with flexural deformation of the piezoelectric element 32. That is, the region corresponding to the upper opening of the pressure chamber 30 in the vibrating plate 31 becomes a driving region 35 in which flexural deformation is permitted. On the other hand, a region separated from the upper opening of the pressure chamber 30 in the vibrating plate 31 becomes a non-driving region 36 in which flexural deformation is inhibited. A vibrating plate opening 38 which connects the reservoir 27 and the liquid introduction path 24 is formed in a region of the vibrating plate 31 which overlaps a portion of the reservoir 27.

In addition, the vibrating plate 31 is formed of, for example, an elastic film formed of silicon dioxide ($SiO_2$) formed on the upper surface of the pressure chamber-forming substrate 29 and an insulating film formed of zirconium oxide ($ZrO_2$) formed on the elastic film. Piezoelectric elements 32 are stacked on regions corresponding to each of the pressure chambers 30 on the insulating film (the surface on the side opposite to the pressure chamber-forming substrate 29 side of the vibrating plate 31), that is, in the driving region 35. The piezoelectric element 32 in the present embodiment is a so-called deflection mode piezoelectric element. In this piezoelectric element 32, for example, a lower electrode layer, a piezoelectric layer, and an upper electrode layer are sequentially stacked on a vibrating plate 31. One of the upper electrode film and the lower electrode film serves as a common electrode formed in common with each of the piezoelectric elements 32, and the other serves as individual electrodes individually formed in each of the piezoelectric elements 32. Then, when an electric field corresponding to the potential difference between the lower electrode layer and the upper electrode layer is applied between the lower electrode layer and the upper electrode layer, the piezoelectric element 32 undergoes flexural deformation in a direction away from or close to the nozzle 26. As a result, the volume of the pressure chamber 30 changes, causing pressure fluctuations in the ink in the pressure chamber 30. The piezoelectric elements 32 in the present embodiment are formed in two parallel rows in the nozzle row direction corresponding to the pressure chambers 30 arranged in two rows in the nozzle row direction.

In addition, the individual terminals 41 and the common terminal 42 are stacked in a region (that is, the non-driving region 36) which is separated from the region overlapping with the pressure chamber 30 of the vibrating plate 31 in the present embodiment. Specifically, the individual terminals 41 are formed outside one row of the piezoelectric elements 32 and outside the other row of the piezoelectric elements 32 in the direction orthogonal to the nozzle row direction, and the common terminals 42 are formed between the rows of both piezoelectric elements 32. The individual terminals 41 are terminals connected to the individual electrode of the piezoelectric element 32 via the lead wiring 37, and are formed for each piezoelectric element 32. On the other hand, the common terminal 42 is a terminal connected to the common electrode of each piezoelectric element 32 via the lead wiring 37, and at least one terminal is formed. In the present embodiment, the common terminal 42 is connected to both the common electrode of one row of the piezoelectric elements 32 and the common electrode of the other row of the piezoelectric element 32. In addition, the lead wiring 37 is formed so as to overlap at least a portion of the pressure chamber 30.

As shown in FIG. 3, the sealing plate 33 is a substrate formed of silicon (for example, a silicon single crystal substrate whose surface crystal plane orientation is (110) plane) arranged at an interval with respect to the piezoelectric element 32 in a state in which a photosensitive adhesive 43 having an insulating property is interposed between the sealing plate 33 and the vibrating plate 31. A plurality of bump electrodes 40 for outputting driving signals from the driving IC 34 to the piezoelectric element 32 side are formed on the lower surface (the surface on the pressure chamber-forming substrate 29 side) of the sealing plate 33 in the present embodiment. As shown in FIG. 3, the bump electrodes 40 are formed at a position corresponding to one individual terminal 41 formed outside one piezoelectric element 32, at a position corresponding to the other individual terminal 41 formed outside the other piezoelectric element 32, and at a position corresponding to the common terminal 42 formed between the rows of both of the piezoelectric elements 32. Each bump electrode 40 is connected to the corresponding individual terminal 41 or the common terminal 42, respectively. In a region of the sealing plate 33 corresponding to the vibrating plate opening 38, a sealing plate opening 39 for connecting the reservoir 27 and the liquid introduction path 24 is formed.

The bump electrode 40 in the present embodiment has elasticity and protrudes from the lower surface of the sealing plate 33 toward the vibrating plate 31 side. Specifically, the bump electrode 40 is provided with a resin having elasticity and a conductive film covering at least a portion of the surface of the resin (none of which are shown). This resin is formed as a ridge along the nozzle row direction on the surface of the sealing plate 33. In addition, a plurality of conductive films which are conductive with the individual terminals 41 are formed in parallel along the nozzle row direction corresponding to the piezoelectric elements 32 arranged in parallel along the nozzle row direction. Furthermore, at least one conductive film which is electrically connected to the common terminal 42 is formed corresponding to the common terminal 42. The bump electrode 40 is not limited to an electrode having a resin. It is also possible to adopt a bump electrode formed only of a metal having no resin in the interior thereof or a bump electrode formed of solder. In addition, the conductive film of the bump electrode 40 extends to a position separated from the resin, and forms the lower surface side wiring 44. In other words, a portion of the lower surface side wiring 44 extends to a position which overlaps with the resin and forms the bump electrode 40. The lower surface side wiring 44 is connected to an upper surface side wiring 46 stacked on the upper surface (on the surface on the opposite side to the pressure chamber-forming substrate 29) of the sealing plate 33 via the through wiring 45 penetrating the sealing plate 33 in the substrate thickness direction at a position separated from the bump electrode 40. The wiring connecting the IC terminal 47 (described below) of the driving IC 34 and the piezoelectric element 32, that is, a series of wirings formed of the lead wiring 37, the individual terminal 41 or the common terminal 42, the bump electrode 40, the lower surface side wiring 44, the through wiring 45, and the upper surface side wiring 46, corresponds to the wiring in the invention.

The photosensitive adhesive 43 for bonding the sealing plate 33 and the pressure chamber-forming substrate 29 on which the vibrating plate 31 is stacked is an adhesive having photosensitivity where the degree of curing changes according to the irradiation of light or having a thermosetting property where the degree of curing changes according to the heating. As such a photosensitive adhesive 43, for example, a resin which includes an epoxy resin, an acrylic resin, a phenol resin, a polyimide resin, a silicone resin, a styrene resin, or the like as a main component is preferably used. As shown in FIG. 3, the photosensitive adhesive 43 in the present embodiment is provided at the outer peripheral portion of the sealing plate 33 and the pressure chamber-forming substrate 29, both sides of the bump electrode 40 in a direction orthogonal to the nozzle row direction, and a portion surrounding the vibrating plate opening 38 and the sealing plate opening 39. That is, the vibrating plate opening 38 and the sealing plate opening 39 communicate in a liquid-tight manner due to the photosensitive adhesive 43. In addition, the space between the pressure chamber-forming substrate 29 and the sealing plate 33 is sealed by the photosensitive adhesive 43. Therefore, the piezoelectric element 32 is sealed in this space (in short, the space surrounded by the pressure chamber-forming substrate 29, the sealing plate 33, and the photosensitive adhesive 43). This sealed space is not completely sealed since the space is open to the atmosphere via a small-diameter atmospheric release passage (not shown) penetrating the sealing plate 33.

The driving IC 34 is an IC chip for driving and controlling the piezoelectric element 32 and is stacked on the upper surface of the sealing plate 33 via an adhesive 48 such as an anisotropic conductive film (ACF). The driving IC 34 in the present embodiment is arranged from a position overlapping the entire row of one of the pressure chambers 30 in the stacking direction of each member to a position overlapping the entire row of the other pressure chamber 30 in the stacking direction of each member. In addition, as shown in FIG. 3, a plurality of IC terminals 47 connected to terminal portions of the upper surface side wiring 46 are formed on the lower surface (the surface on the sealing plate 33 side) of the driving IC 34. A plurality of IC terminals 47 corresponding to the individual terminals 41 of the IC terminals 47 are formed in parallel along the nozzle row direction. In the present embodiment, two rows of IC terminals 47 are formed corresponding to the rows of piezoelectric elements 32 arranged in two rows in parallel. The driving IC 34 is not limited to the illustrated driving IC, and various sizes may be adopted. For example, it is also possible to adopt a driving IC arranged from a position overlapping with a portion (for example, one half on the center side) of one row of the pressure chambers 30 in the stacking direction of each member to a position overlapping a portion of the row of the other pressure chambers 30 (for example, one half side from the center) in the stacking direction of each member. In addition, it is also possible to adopt a configuration in which the driving IC is arranged at a position overlapping with a portion of one row of the pressure chambers 30 in the stacking direction of each member and not overlapping the row of the other pressure chambers 30. Furthermore, it is also possible to adopt a configuration in which the driving IC is arranged so as to overlap only a portion of one pressure chamber 30.

In the recording head 3 configured as described above, ink from the ink cartridge 7 is introduced into the pressure chamber 30 via the liquid introduction path 24, the reservoir 27, the communication port 28, and the like. In this state, if the driving signal COM from the driving IC 34 is supplied to the piezoelectric element 32 via the bump electrode 40, the lead wiring 37, and the like, the piezoelectric element 32 is driven and pressure fluctuations are generated in the ink in the pressure chamber 30 according to the driving signal COM. Due to these pressure fluctuations, the ink in the pressure chamber 30 is ejected as ink droplets from the nozzles 26, or slightly vibrated to such an extent that ink is not ejected from the nozzles 26.

Figure 4:
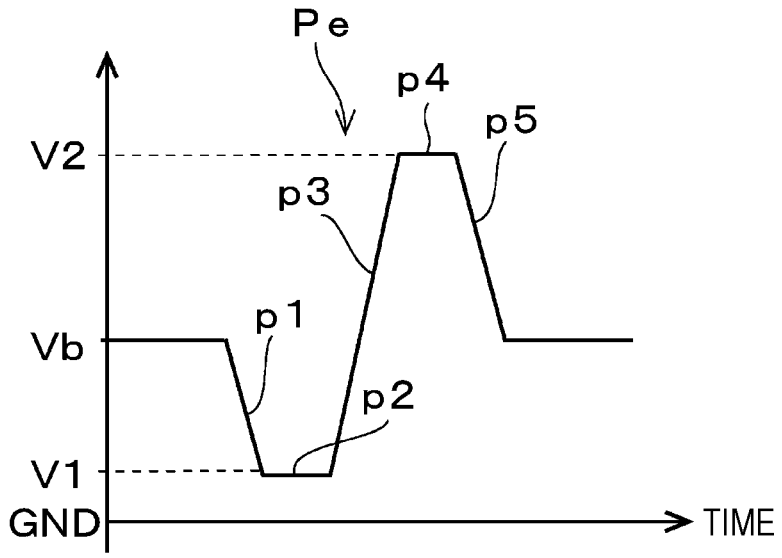
Figure 5:
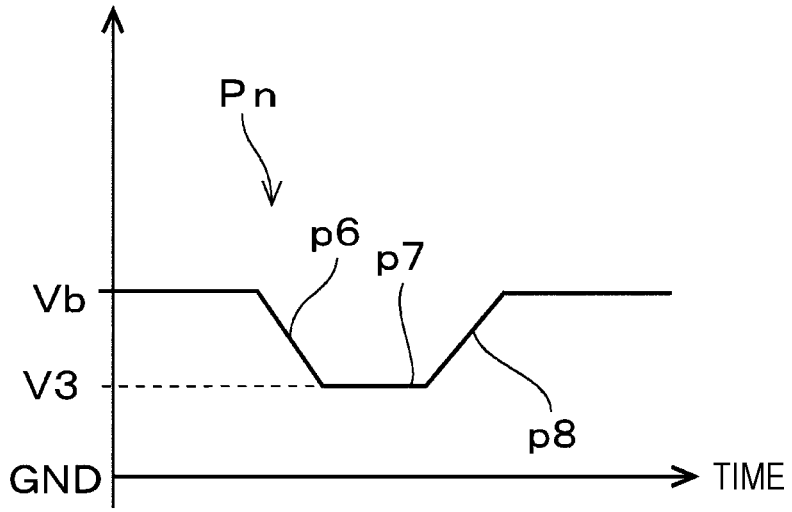

Next, description will be given of the configuration of the driving pulse (driving voltage waveform) included in the driving signal COM. FIG. 4 is a waveform diagram showing an ejection pulse Pe included in the driving signal COM used in a preliminary ejection step or a printing step (one type of main ejection step in the invention) described below, that is, an example of the ejection pulse Pe for ejecting ink droplets from the nozzles 26. FIG. 5 is a waveform diagram showing a non-ejection pulse Pn included in the driving signal COM used in a first preliminary heating step, a second preliminary heating step, and the like described below, that is, an example of the non-ejection pulse Pn which applies minute vibrations to ink in the pressure chamber 30 to the extent that ink is not ejected from the nozzles 26. In FIG. 4 and FIG. 5, the vertical axis represents potential and the horizontal axis represents time.

As shown in FIG. 4, the ejection pulse Pe in the present embodiment includes, for example, an expansion element p1, an expansion maintaining element p2, a contraction element p3, a contraction maintaining element p4, and a restoring element (re-expansion element) p5. The expansion element p1 is an element which changes to the negative side from a reference potential (intermediate potential) Vb to the minimum potential (minimum voltage) V1 to expand the pressure chamber 30. The expansion maintaining element p2 is an element for maintaining the minimum potential V1 for a certain time. The contraction element p3 is an element which changes to the positive side from the minimum potential V1 to the maximum potential (maximum voltage) V2 to sharply contract the pressure chamber 30. The contraction maintaining element p4 is an element for maintaining the maximum potential V2 for a certain time. The restoring element p5 is an element which changes to the negative side from the maximum potential V2 to the reference potential Vb to restore the reference potential Vb.

When such an ejection pulse Pe is applied to the piezoelectric element 32, ink droplets are ejected from the nozzle 26. Specifically, when the expansion element p1 of the ejection pulse Pe is applied to the piezoelectric element 32, the piezoelectric element 32 flexes to the opposite side to the pressure chamber 30 (in a direction away from the nozzle 26), and accordingly, the vibrating plate 31 is displaced (changed) from the reference position corresponding to the reference potential Vb to the highest position corresponding to the minimum potential V1. As a result, the volume of the pressure chamber 30 expands to the maximum volume, the ink flows into the pressure chamber 30 from the reservoir 27, and the meniscus exposed to the nozzle 26 is drawn to the pressure chamber 30 side. The expansion state of the pressure chamber 30 is maintained for a short time during the application period of the expansion maintaining element p2. When the contraction element p3 is applied to the piezoelectric element 32 after the expansion maintaining element p2, the piezoelectric element 32 is flexed toward the pressure chamber 30 side (in the direction toward the nozzle 26), whereby the vibrating plate 31 is suddenly displaced from the highest position up to the lowest position corresponding to the maximum potential V2. As a result, the volume of the pressure chamber 30 rapidly contracts from the maximum volume to the minimum volume. Due to the rapid contraction of the pressure chamber 30, the ink in the pressure chamber 30 is pressurized, and ink droplets of several p1 to several tens of p1 are ejected from the nozzle 26. Subsequently, after the contracted state of the pressure chamber 30 is maintained for a short time over the application period of the contraction maintaining element p4, the restoring element p5 is applied to the piezoelectric element 32 to displace the vibrating plate 31 to the reference position. That is, the pressure chamber 30 returns from the minimum volume corresponding to the maximum potential V2 to the reference volume corresponding to the reference potential Vb.

In addition, as shown in FIG. 5, the non-ejection pulse Pn in the present embodiment includes, for example, the expansion element p6, the expansion maintaining element p7, and the contraction element p8. The expansion element p6 is an element which changes to the negative side from the reference potential (intermediate potential) Vb to a potential (voltage) V3 higher than the minimum potential (minimum voltage) V1 to expand the pressure chamber 30. The expansion maintaining element p7 is an element for maintaining the potential V3 for a certain time. The contraction element (restoring element) p8 is an element which changes to the positive side from the potential V3 to the reference potential Vb and restores the pressure chamber 30 to the reference volume. The non-ejection pulse Pn in the present embodiment is used not only in the first preliminary heating step, the second preliminary heating step, and the like, but also in the printing step. That is, in the printing operation, the non-ejection pulse Pn is also applied to the piezoelectric element 32 corresponding to the nozzle 26 from which ink is not ejected. In addition, the generation period (rising time or falling time) of the expansion element p6 and the contraction element p8 of the non-ejection pulse Pn is longer than the generation period of the expansion element p1 and the restoring element p5 of the ejection pulse Pe.

When such non-ejection pulse Pn is applied to the piezoelectric element 32, the ink in the pressure chamber 30 minutely vibrates to the extent that ink droplets are not ejected from the nozzle 26. More specifically, when the expansion element p6 of the non-ejection pulse Pn is applied to the piezoelectric element 32, the piezoelectric element 32 flexes relatively gently to the opposite side to the pressure chamber 30 (in a direction away from the nozzle 26), and the vibrating plate 31 is displaced (changed) accordingly from the reference position corresponding to the reference potential Vb to the position corresponding to the potential V3. As a result, the volume of the pressure chamber 30 gently expands. The expansion state of the pressure chamber 30 is maintained for a predetermined time during the application period of the expansion maintaining element p7. Thereafter, the contraction element p8 is applied to the piezoelectric element 32, and the vibrating plate 31 returns to the reference position from the position corresponding to the potential V3. That is, the pressure chamber 30 contracts relatively gently from the volume corresponding to the potential V3 to the reference volume corresponding to the reference potential Vb. Due to the expansion and contraction of the pressure chamber 30, pressure vibrations are generated in the ink in the pressure chamber 30 to such an extent that ink droplets are not ejected from the nozzles 26. As a result, the ink in the pressure chamber 30 and in the nozzle 26 is stirred.

Figure 6:
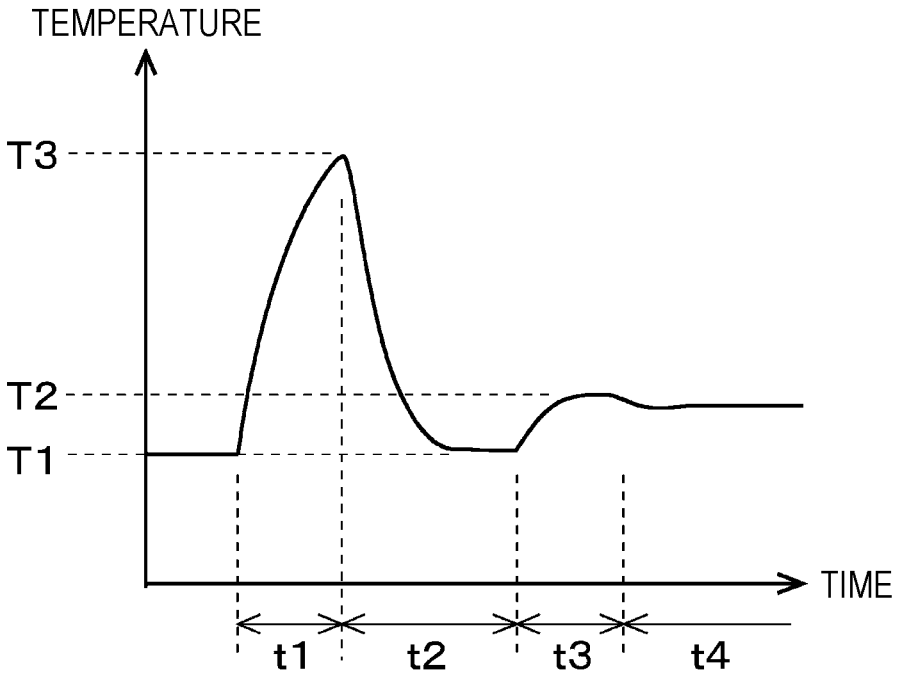
FIG. 6 is an explanatory diagram showing a first maintenance operation before starting a printing operation.
Figure 7:
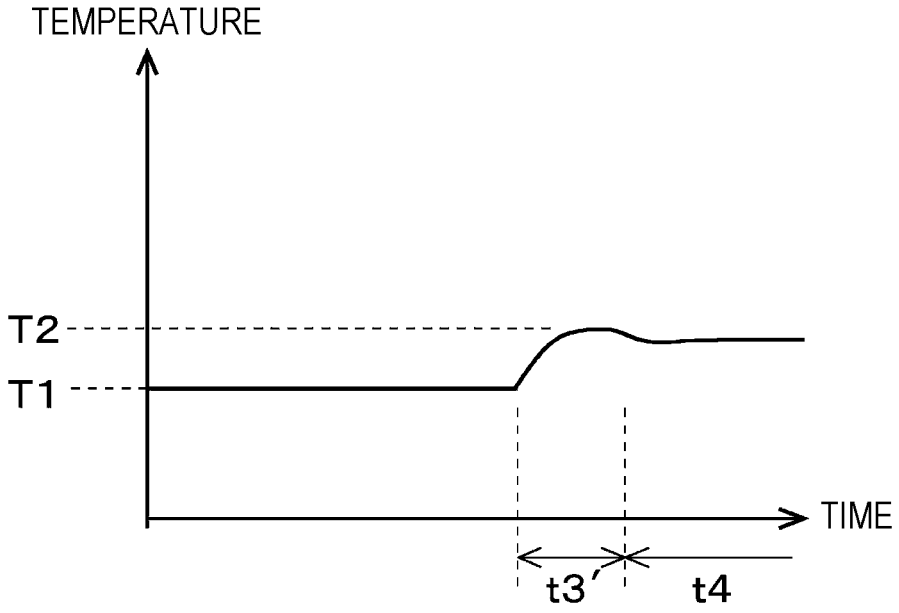
FIG. 7 is an explanatory diagram showing a second maintenance operation before starting a printing operation.

Next, description will be given of a maintenance operation of the recording head 3 for performing a printing operation. FIG. 6 and FIG. 7 are explanatory views showing the temperature of the ink in the pressure chamber 30 in the printing operation and the maintenance operation before the start of the printing operation. In FIG. 6 and FIG. 7, the vertical axis represents temperature and the horizontal axis represents time. The maintenance operation of the recording head 3 in the present embodiment is provided with a first maintenance operation mode carrying out a first preliminary heating step of heating the ink in the pressure chamber 30, a preliminary ejection step of ejecting ink in the pressure chamber 30 from the nozzles 26 after the first preliminary heating step, and a second preliminary heating step of heating ink in the pressure chamber 30 more weakly than the first preliminary heating step after the preliminary ejection step, and a second maintenance operation mode carrying out the third preliminary heating step of heating the ink in the pressure chamber 30 without carrying out the first preliminary heating step and the preliminary ejection step.

The first maintenance operation mode is an operation mode performed on the nozzles 26 for which ink is not ejected for a certain period of time, the nozzles 26 for which an ink ejection failure is detected, and the like. In the nozzles 26 in which the ink is not ejected for a certain period of time, local drying tends to occur in the meniscus in the nozzle 26, and the viscosity of the ink in the nozzle 26 and in the pressure chamber 30 also tends to rise, thus there is a concern that it will not be possible to generate sufficient pressure fluctuations in the ink in the pressure chamber 30 for the ejection of ink. In particular, such a state is likely to occur in a low-temperature and low-humidity environment. Therefore, in the first maintenance operation mode, as shown in FIG. 6, during the first period t1 before the printing operation, the piezoelectric element 32 is driven and controlled to heat the ink in the pressure chamber 30 (the first preliminary heating step). Specifically, the driving signal COM including the non-ejection pulse Pn is applied to the piezoelectric element 32 such that the ink in the pressure chamber 30 is minutely vibrated to an extent that ink is not ejected from the nozzles 26 (for example, under a condition that ink is not ejected). At this time, the piezoelectric element 32, the driving IC 34, wiring such as the lead wiring 37, and the like generate heat, and this heat propagates to the ink in the pressure chamber 30 via the sealing plate 33, the vibrating plate 31, and the like. As a result, the temperature of the ink in the pressure chamber 30 is heated from the ambient temperature T1 to the preliminary heating temperature T3. As a result, the viscosity of the ink in the pressure chamber 30 decreases, and the dried and thickened ink in the nozzle 26 is stirred.

It is possible to adopt various configurations for the driving method of the piezoelectric element 32 in the first preliminary heating step, that is, the configuration of the driving signal COM. For example, it is possible to adopt a configuration in which the non-ejection pulse Pn is repeatedly applied to the piezoelectric element 32 at every unit period. In this case, since the piezoelectric element 32 is driven to generate minute vibrations in the ink in the pressure chamber 30 during the first period t1, it is possible to increase the heating rate of the ink in the pressure chamber 30. In addition, in order to suppress excessive increases in the temperature of the ink in the pressure chamber 30, it is also possible to adopt a configuration in which a standby period in which a driving signal (driving voltage) is not applied to the piezoelectric element 32 is provided, or the ejection pulse Pe is applied to the piezoelectric element 32. More specifically, it is possible to adopt a driving signal COM alternately repeating the period during which the non-ejection pulse Pn is applied to the piezoelectric element 32 and the standby period in which the driving signal (driving voltage) is not applied to the piezoelectric element 32, a driving signal COM alternately repeating a period of applying the non-ejection pulse Pn to the piezoelectric element 32 and a period of applying the ejection pulse Pe to the piezoelectric element 32, or the like. In short, in the first preliminary heating step, it is possible to adopt various configurations for the configuration of the driving signal COM and it is sufficient if it is possible to heat the temperature of the ink in the pressure chamber 30 up to a preliminary heating temperature T3 by applying the driving signal COM including at least the non-ejection pulse Pn to the piezoelectric element 32.

Next, in a second period t2 after the first preliminary heating step, the piezoelectric element 32 is driven and controlled to eject ink droplets from the nozzle 26 (preliminary ejection step). Specifically, the driving signal COM including the ejection pulse Pe is applied to the piezoelectric element 32 so as to eject ink droplets from the nozzle 26. At this time, in the first preliminary heating step, the ink in the pressure chamber 30 and the ink in the nozzle 26 is stirred and enters a state in which the viscosity of these inks is lower than the state before the first preliminary heating step, thus the ink in the pressure chamber 30 is easily ejected. As a result, the dried and thickened ink and the solidified ink are easily discharged. In addition, foreign matter, bubbles, and the like are easily discharged together with the ink. As a result, even in a case where the nozzle 26 is in an ejection failure state, it is possible to refresh (restore) the nozzle 26 to a state in which normal ink ejection is possible. As the ink is ejected, heat in the pressure chamber 30 is expelled. In other words, the heat in the pressure chamber 30 is expelled together with the ink. As a result, as shown in FIG. 6, the temperature of the ink in the pressure chamber 30 is decreased to a temperature lower than a predetermined temperature (printing temperature) T2 suitable for printing. In the present embodiment, the temperature of the ink in the pressure chamber 30 is decreased to the ambient temperature T1. The ejection of ink droplets in the preliminary ejection step is performed in a region separated from the printing region. For example, the recording head 3 is moved above a flushing box (not shown) provided in a region separated from the region where the recording medium 2 is transported, and ink droplets are ejected toward the flushing box.

In addition, it is possible to adopt various configurations for the driving method of the piezoelectric element 32 in the preliminary ejection step, that is, the configuration of the driving signal COM. For example, it is possible to adopt a configuration in which the ejection pulse Pe is repeatedly applied to the piezoelectric element 32 at every unit period. In this case, since the piezoelectric element 32 is driven during the second period t2 to eject the ink in the pressure chamber 30, it is possible to increase the cooling rate of the ink in the pressure chamber 30. In addition, it is also possible to adopt a configuration in which a standby period in which a driving signal (driving voltage) is not applied to the piezoelectric element 32 is provided, or a non-ejection pulse Pn is applied to the piezoelectric element 32. More specifically, it is possible to adopt a driving signal COM which alternately repeats a period in which the ejection pulse Pe is applied to the piezoelectric element 32 and a standby period in which the driving signal (driving voltage) is not applied to the piezoelectric element 32, a driving signal COM which alternately repeats a period in which the ejection pulse Pe is applied to piezoelectric element 32 and a period in which the non-ejection pulse Pn is applied to the piezoelectric element 32, or the like. In short, in the preliminary ejection step, it is possible to adopt various configurations for the configuration of the driving signal COM and it is sufficient if it is possible to cool the temperature of the ink in the pressure chamber 30 to a temperature lower than the printing temperature T2 by applying the driving signal COM including at least the ejection pulse Pe to the piezoelectric element 32.

Finally, in the preliminary ejection step, when the ink in the pressure chamber 30 is discharged, during the third period t3 after the preliminary ejection step, the piezoelectric element 32 is driven and controlled to again heat the ink in the pressure chamber 30 (second preliminary heating step). Specifically, the driving signal COM including the non-ejection pulse Pn is applied to the piezoelectric element 32 such that the ink in the pressure chamber 30 is minutely vibrated to an extent that ink is not ejected from the nozzles 26 (for example, under a condition that ink is not ejected). As a result, the piezoelectric element 32, the driving IC 34, wiring such as the lead wiring 37, and the like generate heat, and this heat propagates to the ink in the pressure chamber 30 via the sealing plate 33, the vibrating plate 31, and the like and the ink in the pressure chamber 30 is heated again. By adjusting the configuration (for example, the frequency of the driving signal COM, the number of non-ejection pulses Pn, and the like) of the driving signal COM applied to the piezoelectric element 32, the amount of heat generated by the piezoelectric element 32, the driving IC 34, and the wiring such as the lead wiring 37 is smaller than the amount of heat generated in the first preliminary heating step. As a result, the temperature of the ink in the pressure chamber 30 is heated to the printing temperature T2 lower than the preliminary heating temperature T3. In addition, the ink in the pressure chamber 30 and the ink in the nozzle 26 are stirred.

As for the driving method of the piezoelectric element 32 in the second preliminary heating step, that is, the configuration of the driving signal COM, it is possible to adopt various configurations similarly to the first preliminary heating step. For example, similarly to the first preliminary heating step, it is also possible to adopt a configuration in which the non-ejection pulse Pn is repeatedly applied to the piezoelectric element 32 at every unit period. In such a case, it is possible to increase the heating rate of the ink in the pressure chamber 30. In addition, in order to suppress excessive increases in the temperature of the ink in the pressure chamber 30, it is also possible to adopt a configuration in which a standby period in which a driving signal (driving voltage) is not applied to the piezoelectric element 32 is provided, or the ejection pulse Pe is applied to the piezoelectric element 32. Specifically, it is possible to adopt a configuration alternately repeating the period during which the non-ejection pulse Pn is applied to the piezoelectric element 32 and the standby period in which the driving signal (driving voltage) is not applied to the piezoelectric element 32, a driving signal COM alternately repeating a period of applying the non-ejection pulse Pn to the piezoelectric element 32 and a period of applying the ejection pulse Pe to the piezoelectric element 32, or the like. In short, in the second preliminary heating step, it is possible to adopt various configurations for the configuration of the driving signal COM and it is sufficient if it is possible to heat the temperature of the ink in the pressure chamber 30 up to a printing temperature T2 by applying the driving signal COM including at least the non-ejection pulse Pn to the piezoelectric element 32.

In this manner, when the maintenance operation is performed, in the fourth period t4 after the second preliminary heating step, a printing operation is started (a printing step which is one type of main ejection step in the invention). That is, in a state in which the temperature of the ink in the pressure chamber 30 has reached the printing temperature T2, ink is ejected from the nozzle 26 toward the recording medium 2. As a result, an image or the like is formed on the recording medium 2. The piezoelectric element 32, the driving IC 34, and the wiring such as the lead wiring 37 generates heat due to the printing operation, but this heat is expelled together with the ink, such that it is possible to suppress excessive increases in the temperature in the pressure chamber 30. In addition, in the present embodiment, since the driving IC 34 is exposed to the case opening 21 and is exposed to the atmosphere, it is possible to further suppress excessive heating of the driving IC 34. The printing operation is an operation in the main ejection step of the invention and means an operation of causing the liquid ejected from the nozzle 26 to be deposited on a predetermined position of the recording medium. For example, in addition to the operation of ejecting ink onto the recording medium 2 as in the present embodiment, a printing operation includes an operation of ejecting a color material to a color filter used for a display or the like, or an operation of ejecting a bioorganic solution onto a substrate for a biochip.

In addition, the second maintenance operation mode is an operation mode performed in cases such as where the printing operation is continuously performed or the like, where the ink in the pressure chamber 30 and the ink in the nozzle 26 are not thickened, or where bubbles, foreign matter, and the like are not mixed in the ink in the pressure chamber 30 or the ink in the nozzle 26 and normal ink ejection is able to be performed. In such a case, since it is unnecessary to discharge thickened ink, foreign matter, bubbles, and the like, there is no need to perform a preliminary ejection step. That is, the piezoelectric element 32 is driven and controlled in the third period t3' before the printing step (the fourth period t4) without performing the first preliminary heating step and the preliminary ejection step, and the ink in the pressure chamber 30 is heated (third preliminary heating step). Specifically, a driving signal COM similar to that in the second preliminary heating step is applied to the piezoelectric element 32 so as to minutely vibrate the ink in the pressure chamber 30 to such an extent that ink is not ejected from the nozzle 26. At this time, the piezoelectric element 32, the driving IC 34, and wiring such as the lead wiring 37 generate heat, and this heat propagates to the ink in the pressure chamber 30 via the sealing plate 33, the vibrating plate 31, and the like. As a result, the temperature of the ink in the pressure chamber 30 is heated from the ambient temperature T1 to the printing temperature T2. Then, in this state, that is, in a state in which the temperature of the ink in the pressure chamber 30 has reached the printing temperature T2, a printing operation for ejecting ink from the nozzle 26 toward the recording medium 2 is started (a printing step which is a type of main ejection step in the invention). For the driving method of the piezoelectric element 32 in the third preliminary heating step, that is, the configuration of the driving signal COM, it is also possible to adopt various configurations similarly to the second preliminary heating step.

In this manner, in the first maintenance operation mode, since it is possible to lower the viscosity of the ink by heating the ink in the pressure chamber 30 in the first preliminary heating step, ink is easily ejected from the nozzle 26 in the preliminary ejection step. As a result, it is possible to eject solidified ink, thickened ink, and the like, and to refresh the nozzle 26. In addition, after the temperature of the ink in the pressure chamber 30 is brought close to the ambient temperature T1 by ejecting the ink in the preliminary ejection step, it is also possible to set the temperature of the ink in the pressure chamber 30 to the printing temperature T2 by heating the ink in the pressure chamber 30 in the second preliminary heating step without using the result of the temperature detection by the temperature detection means for detecting the temperature of the ink in the pressure chamber 30. That is, when the ink in the pressure chamber 30 warmed in the first preliminary heating step is cooled by the ejection of ink in the preliminary ejection step, it is sufficient to eject ink until the ink in the pressure chamber 30 approaches the ambient temperature T1, or reaches the ambient temperature T1, thus it is not necessary to accurately determine the temperature of the ink in the pressure chamber 30. As a result, for example, even in a case where it is not possible to accurately determine the temperature detection by the temperature detection means, it is possible to suppress deterioration of the image quality formed on the recording medium 2 since ink is ejected at a predetermined temperature (printing temperature T2) suitable for operations such as printing. As a result, it is possible to increase the reliability of the recording head 3. Furthermore, for example, it is also possible to eliminate the temperature detection means for detecting the temperature of the ink in the pressure chamber 30, and to simplify the configuration of the recording head 3.

In addition, in the present embodiment, since the driving signal COM (non-ejection pulse Pn) is applied to the piezoelectric element 32 to cause the piezoelectric element 32, the driving IC 34, and wiring such as the lead wiring 37 to generate heat, pressure fluctuations occur in the ink in the pressure chamber 30, and it is possible to stir the ink in the pressure chamber 30. As a result, in the preliminary ejection step, the ink is more easily ejected from the nozzles 26, and the thickened ink or the like is more easily discharged. Furthermore, in the present embodiment, in the first preliminary heating step and the second preliminary heating step, since the driving IC 34 applies the non-ejection pulse Pn to the plurality of piezoelectric elements 32, each of the wirings of the piezoelectric element 32, the driving IC 34, and the lead wiring 37 easily generates heat, and the heating efficiency of the ink in the pressure chamber 30 is improved in comparison with a case of heating the ink in the pressure chamber 30 without applying the driving signal COM to the piezoelectric element 32, which will be described below. As will be described below, it is also possible to heat the ink in the pressure chamber 30 without applying the driving signal COM to the piezoelectric element 32; however, from the viewpoint of improving the heating efficiency of the ink in the pressure chamber 30, it is desirable that the driving IC 34 apply the non-ejection pulse Pn to at least one piezoelectric element 32 in at least one of the first heating step or the second preliminary heating step.

Further, the non-ejection pulse Pn applied to the piezoelectric element 32 in the first preliminary heating step and the second preliminary heating step is the same as the driving pulse applied to the piezoelectric element 32 corresponding to the nozzle 26 from which ink is not ejected in the printing operation, thus a separate circuit for generating driving pulses used for printing operations is not necessary, and the configuration of the recording head 3 is simplified. In addition, switching of the driving pulse becomes unnecessary, and it is possible to shorten the shift from the second preliminary heating step to the printing step. Furthermore, since the driving IC 34 in the present embodiment is arranged so as to overlap at least a portion of the pressure chamber 30, it is possible to efficiently transmit (propagate) the heat of the driving IC 34 to the ink in the pressure chamber 30. As a result, it is possible to suppress the power consumption of the driving IC 34 and thus the recording head 3. In particular, since the driving IC 34 is arranged from a position overlapping with one row of the pressure chambers 30 to a position overlapping with the other row of the pressure chambers 30, it is possible to suppress variations between the temperature of the ink in one row of the pressure chambers 30 and the temperature of the ink in the other row of the pressure chambers 30. As a result, it is possible to suppress variations in the ejection characteristics of ink ejected from nozzles 26 corresponding to one row of pressure chambers 30 and ejection characteristics of ink ejected from nozzles 26 corresponding to the other row of pressure chambers 30.

In the present embodiment, since the reservoir 27 and the pressure chamber 30 communicate with each other through the communication port 28, in the first preliminary heating step, even when pressure fluctuations are caused in the ink in the pressure chamber 30 to stir the ink in the pressure chamber 30, it is possible to suppress the solidified ink, the thickened ink, and the like from reaching the reservoir 27. As a result, it is possible to suppress the ink ejection amount (consumption amount) in the preliminary ejection step. That is, it is possible to suppress the consumption of a large amount of ink by discharging the solidified ink, the thickened ink, and the like reaching the reservoir 27.

It is possible to appropriately determine which of the first maintenance operation mode or the second maintenance operation mode is to be performed for each nozzle 26 (that is, for each piezoelectric element 32). That is, either one of the first maintenance operation mode and the second maintenance operation mode may be applied to each of the nozzles 26 in accordance with the frequency of use of the nozzles 26, the presence or absence of ejection failures in the nozzles 26, or the like, and the first maintenance operation mode or the second maintenance operation mode may be applied to all the nozzles 26. In a case where the printing operation has not been performed for a certain period of time, it is desirable to apply the first maintenance operation mode to all the nozzles 26. In this manner, it is possible to more reliably suppress ejection failures of the ink. On the other hand, in the case where the printing operation is performed in a relatively short period of time from the previous printing operation, it is desirable to determine whether to apply the first maintenance operation mode or the second maintenance operation mode for each nozzle 26. In a case where there is no ejection failure or the like in all the nozzles 26, it is also possible to apply the second maintenance operation mode to all the nozzles 26. In this manner, it is possible to suppress unnecessary ejection of ink, and to suppress the consumption of ink. In addition, in a case where the second maintenance operation mode is applied to all of the nozzles 26, it is also possible to omit the period t1 and the period t2. In this manner, it is possible to shorten the time until the printing operation is completed. In either case, the maintenance operation of either the first maintenance operation mode or the second maintenance operation mode is applied to at least the nozzles 26 used for the printing operation. In short, the nozzles 26 used for the printing operation minutely vibrate the ink in the pressure chambers 30 in the periods t3, t3' before the printing operation, and then eject the ink.

It is desirable for the same maintenance operation mode to be applied to each of the plurality of nozzles 26 (specifically, the nozzle 26, the corresponding pressure chamber 30, and the corresponding piezoelectric element 32) communicating with the same reservoir 27. In addition, in the case where the first maintenance operation mode is applied to each of a plurality of the nozzles 26 communicating with the same reservoir 27, it is desirable that, in the preliminary ejection step, the ejection amounts of ink ejected from the plurality of nozzles 26 communicating with the same reservoir 27 be set to be approximately the same amount. That is, in the preliminary ejection step, it is desirable to apply the driving signal COM having the same configuration to a plurality of piezoelectric elements 32 corresponding to a plurality of the pressure chambers 30 (for example, one row of the pressure chambers 30 or the other row of pressure chambers 30 in FIG. 3) communicating with the same reservoir 27. In this manner, since the temperatures of each of the pressure chambers 30 communicating with the same reservoir 27 (in particular, the printing temperature T2) are easily set to the same temperature, it is possible to suppress variations in the ejection characteristics between the nozzles 26 communicating with the same reservoir 27. Furthermore, it is desirable that the driving signal COM applied to the piezoelectric elements 32 corresponding to the plurality of pressure chambers 30 communicating with the same reservoir 27 have the same configuration not only in the preliminary ejection step, but also in each of the preliminary heating steps (the first preliminary heating step, the second preliminary heating step, and the third preliminary heating step). In this manner, since the temperature (particularly the printing temperature T2) of each pressure chamber 30 communicating with the same reservoir 27 is more likely to be uniform at the same temperature, it is possible to more reliably suppress variations in the ejection characteristics between the nozzles 26 communicating with the same reservoir 27. In addition, even for the nozzles 26 not communicating with the same reservoir 27, it is desirable that the same driving signal COM be applied to the piezoelectric element 32 corresponding to the nozzles 26 which eject ink of the same color. That is, it is desirable that not only is the same maintenance operation mode applied to the piezoelectric elements 32 corresponding to the nozzles 26 ejecting the ink of the same color, but that the driving signal COM applied in each step (the first preliminary heating step, the preliminary ejection step, the second preliminary heating step, and the third preliminary heating step) also have the same waveform. In this manner, since the temperatures (in particular, the printing temperature T2) of each of the pressure chambers 30 to which the ink of the same color is supplied are easily set to the same temperature, it is possible to more reliably suppress variations in ejection characteristics among the nozzles 26 ejecting ink of the same color.

In the first embodiment described above, the recording head 3 provided with two rows of nozzle rows is exemplified, but the invention is not limited thereto. For example, it is also possible to adopt a configuration provided with one row of nozzle rows, or a configuration provided with three or more nozzle rows. In addition, the invention is not limited to being provided with a nozzle row in which the nozzles 26 are linearly arranged, and it is also possible to adopt configuration in which the nozzles 26 are arranged in a zigzag manner or a configuration in which the nozzles 26 are arranged in a more complicated manner. In addition, the ejection pulse and the non-ejection pulse used in the first maintenance operation mode and the second maintenance operation mode are not limited to those illustrated in FIG. 4 and FIG. 5. Any driving pulse (driving voltage waveform) may be used as the ejection pulse as long as it is possible to eject ink from the nozzle 26. Furthermore, as a non-ejection pulse, any driving pulse (driving voltage waveform) may be used as long as it is possible to apply pressure fluctuations to the ink in the pressure chamber 30 to such an extent that ink is not ejected from the nozzle 26. In addition, the driving signal COM used in each step (the first preliminary heating step, the preliminary ejection step, the second preliminary heating step, and the third preliminary heating step) is not limited to a driving signal COM formed of one type of ejection pulse or one type of non-ejection pulse, but may be a driving signal COM combining a plurality of types of ejection pulses or a plurality of types of non-ejection pulses.

In addition, in the preliminary ejection step, it is desirable to adopt a driving signal COM which ejects ink by resonating with the period (natural vibration period) Tc of the pressure vibrations occurring in the ink in the pressure chamber 30. In such a case, it is possible to increase the vibration of the meniscus and to stably eject the ink. On the other hand, in each of the preliminary heating steps (the first preliminary heating step, the second preliminary heating step, and the third preliminary heating step), a driving signal COM having a period faster than the natural vibration period Tc may be adopted, or a driving signal COM having a period slower than the natural vibration period Tc may be adopted. In a case where a driving signal COM having a period faster than the natural vibration period Tc is adopted, the amount of heat generated by the piezoelectric element 32 increases, and it is possible to improve the heating efficiency of the ink in the pressure chamber 30. In a case of adopting a driving signal COM having a period slower than the natural vibration period Tc, it is possible to reduce the current (effective value) flowing through the wiring such as the lead wiring 37. As a result, it is possible to suppress electromigration and the like in the wiring. Furthermore, in the case of applying the same driving signal COM to the plurality of piezoelectric elements 32 in the maintenance operation, it is desirable to apply the driving signal COM at time intervals rather than simultaneously to all these piezoelectric elements 32. For example, a group formed of one or more piezoelectric elements 32 is set, and a driving waveform is applied with a time difference between each group. In this manner, it is possible to reduce the current flowing through the wiring (in particular, the wiring such as the lead wiring 37 corresponding to the common electrode). As a result, it is possible to further suppress electromigration and the like in the wiring.

Furthermore, in the first embodiment described above, in each of the preliminary heating steps (the first preliminary heating step, the second preliminary heating step, and the third preliminary heating step), the piezoelectric element 32, the driving IC 34, and the wiring such as the lead wiring 37 generates heat, but the invention is not limited thereto. As long as it is possible to heat the ink in the pressure chamber 30, any one of the piezoelectric element 32, the driving IC 34, the wiring such as the lead wiring 37, and the like may be caused to generate heat. That is, it is sufficient if at least any one of the piezoelectric element 32, the driving IC 34, the wiring such as the lead wiring 37, and the like generates heat. For example, by adjusting the electric resistance or the like of the wiring forming the piezoelectric element 32 and the driving IC 34 and the electric resistance or the like of the wiring such as the lead wiring 37, it is also possible for any one of the piezoelectric element 32, the driving IC 34, and the wiring such as the lead wiring 37 to easily generate heat. Furthermore, in each preliminary heating step of the first embodiment described above, by applying the driving signal COM including the non-ejection pulse Pn to the piezoelectric element 32, the piezoelectric element 32, the driving IC 34, the wiring such as the lead wiring 37 and the like generate heat, but the invention is not limited thereto. For example, instead of applying the driving signal COM to the piezoelectric element 32, it is possible to cause the driving IC 34 to generate heat by switching the switching circuit 17 of the driving IC 34 on and off.

Figure 8:
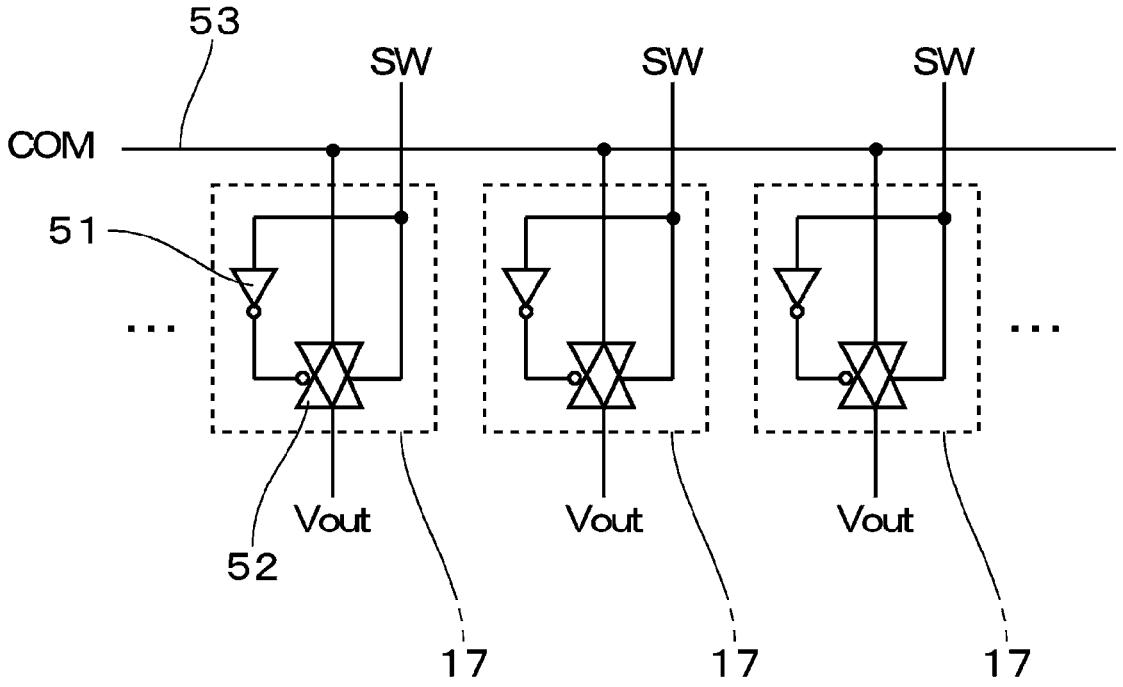
FIG. 8 is a circuit diagram illustrating a configuration of a switching circuit.

A detailed description will be given of the heat generation of the driving IC 34 by the switching circuit 17 with reference to FIG. 8. FIG. 8 is a circuit diagram illustrating the configuration of the switching circuit 17 in the present embodiment. The switching circuit 17 in the present embodiment has an inverter (NOT circuit) 51 and a transfer gate 52, and a plurality of the switching circuits 17 are provided corresponding to the plurality of piezoelectric elements 32. The selection signal SW from the head control circuit is supplied to the positive control terminal not marked with a circle in the transfer gate 52, while being supplied to the negative control terminal marked with a circle in the transfer gate 52 by being logically inverted by the inverter 51. In addition, the input terminal of the transfer gate 52 is connected to the IC wiring 53, and the driving signal COM is supplied through the IC wiring 53. Furthermore, the output terminal of the transfer gate 52 is connected to the individual electrode of the corresponding piezoelectric element 32. When the selection signal SW is high level, the transfer gate 52 conducts (ON) between the input terminal and the output terminal, and when the selection signal SW is low level, the transfer gate 52 does not conduct (OFF) between the input terminal and the output terminal. By repeating this selection signal SW switching, the transfer gate 52 generates heat. That is, regardless of whether or not the driving signal COM is supplied to the switching circuit 17, by supplying the selection signal SW to the switching circuit 17 and turning the switching circuit 17 on and off repeatedly, it is possible for the switching circuit 17, that is, the driving IC 34 to generate heat. It is possible for the ink in the pressure chamber 30 to be heated utilizing the heat generated by the driving IC 34. In this manner, it is possible to heat the ink in the pressure chamber 30 without driving the piezoelectric element 32, that is, without supplying the driving signal COM to the input terminal of the switching circuit 17. As a result, it is possible to suppress the power consumption of the driving IC 34, and thus the power consumption of the recording head 3. In the case of heating the ink in the pressure chamber 30 by causing the driving IC 34 to generate heat only by switching on and off of the switching circuit 17 without driving the piezoelectric element 32, the amount of heat generated by the driving IC 34 is small in comparison with a case where the ink in the pressure chamber 30 is heated by driving the piezoelectric element 32 as in the embodiment described above. In addition, since the piezoelectric element 32 is not driven, there is no heat generated by the piezoelectric element 32, the lead wiring 37, and the like. Therefore, it is desirable to carry out the method of causing the driving IC 34 to generate heat only by switching on and off of the switching circuit 17 in a second preliminary heating step or a third preliminary heating step, in which the heating amount is smaller than that in the first preliminary heating step. The switching circuit 17 is not limited to a circuit using a CMOS transfer gate, but it is also possible to adopt a circuit using an nMOS transfer gate or a pMOS transfer gate.

The configuration of the recording head 3 is not limited to the above-described configuration, and it is possible to adopt various configurations as long as the recording head 3 is provided with the pressure chamber 30, the nozzle 26, the piezoelectric element 32, and the driving IC 34. For example, FIG. 9 to FIG. 16 illustrate the recording head 3 having other configurations.

Figure 9:
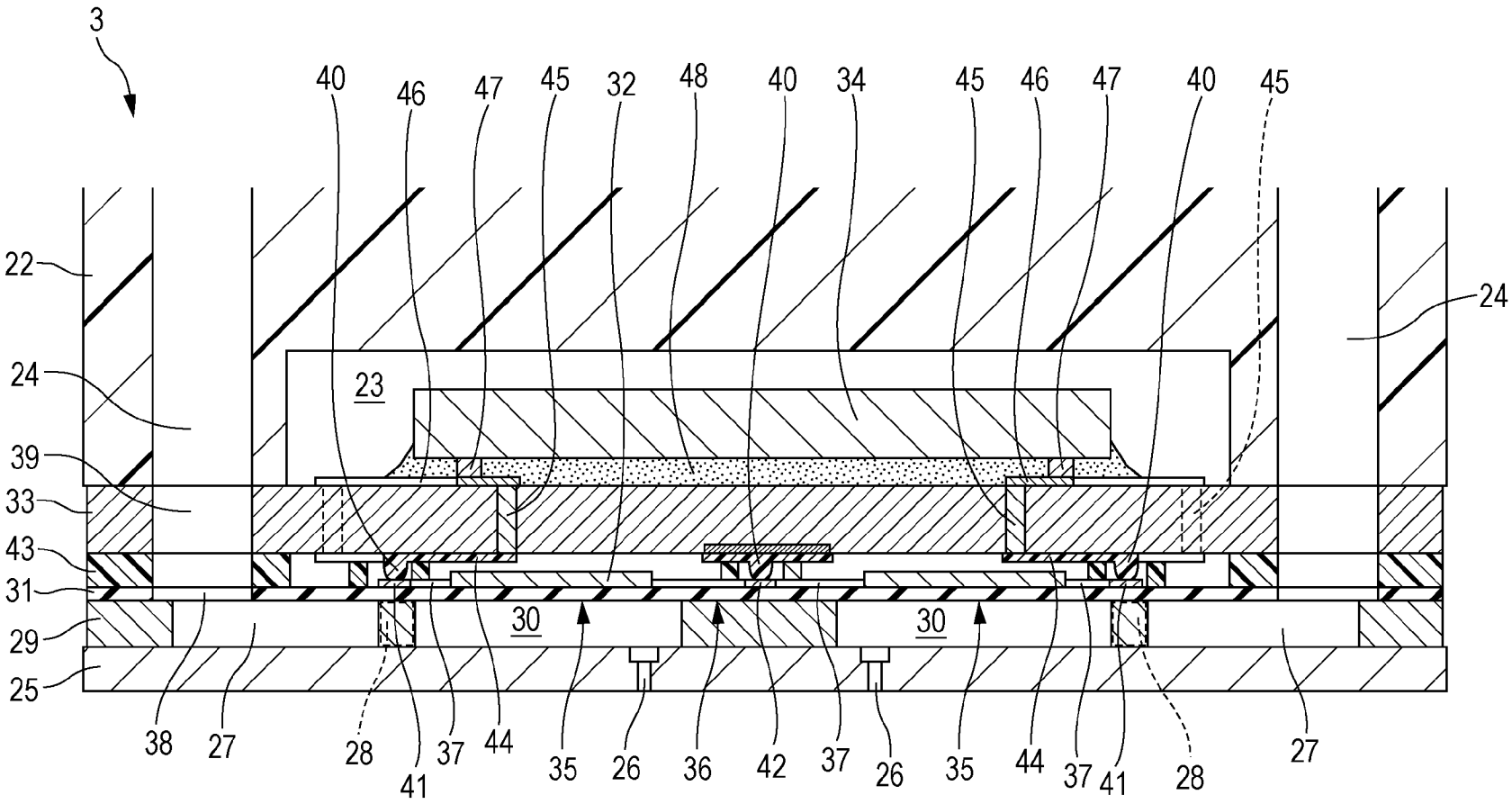
FIG. 9 is a cross-sectional view illustrating a configuration of a recording head in a second embodiment.

Specifically, in the recording head 3 of the second embodiment shown in FIG. 9, a case opening is not provided in the head case. That is, the driving IC 34 is sealed in the accommodating space 23. In addition, the upper surface of the driving IC 34 and the head case (specifically, the ceiling surface of the accommodating space 23) are in a hollow state without contacting each other. As a result, it is possible to efficiently transmit the heat generated by the driving IC 34 to the sealing plate 33 side. That is, in each preliminary heating step, it is possible to efficiently heat the ink in the pressure chamber 30 using the heat generated by the driving IC 34. In addition, in the printing step, the efficiency of the heat expulsion due to the ejection of ink is improved. Since the configuration in other respects is the same as the first embodiment described above, description thereof will be omitted.

Figure 10:
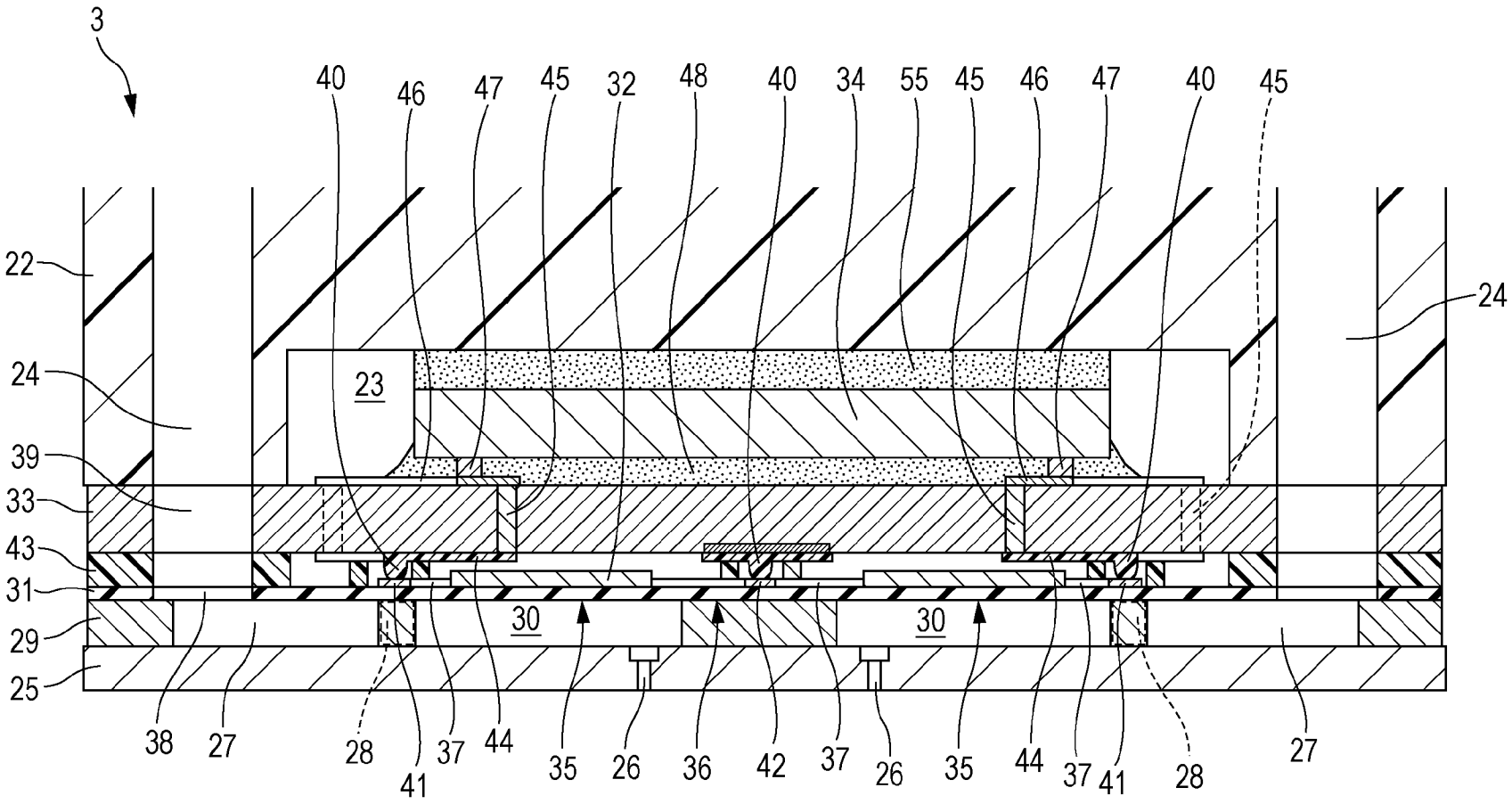
FIG. 10 is a cross-sectional view illustrating a configuration of a recording head in a third embodiment.

The recording head 3 in the third embodiment shown in FIG. 10 is different from the second embodiment described above in that an adhesive 55 is filled between the upper surface of the driving IC 34 and the head case. That is, the upper surface of the driving IC 34 in the present embodiment is adhered to the ceiling surface of the accommodating space 23. As the adhesive 55 for adhering the driving IC 34 and the head case, an adhesive having a thermal conductivity lower than the thermal conductivity of the sealing plate 33 is suitably used. In this manner, it is possible to suppress the heat generated in the driving IC 34 from escaping to the adhesive 55 side. Therefore, it is possible to more efficiently transmit the heat generated by the driving IC 34 to the sealing plate 33 side. Since the configuration in other respects is the same as the second embodiment, description thereof will be omitted.

Figure 11:
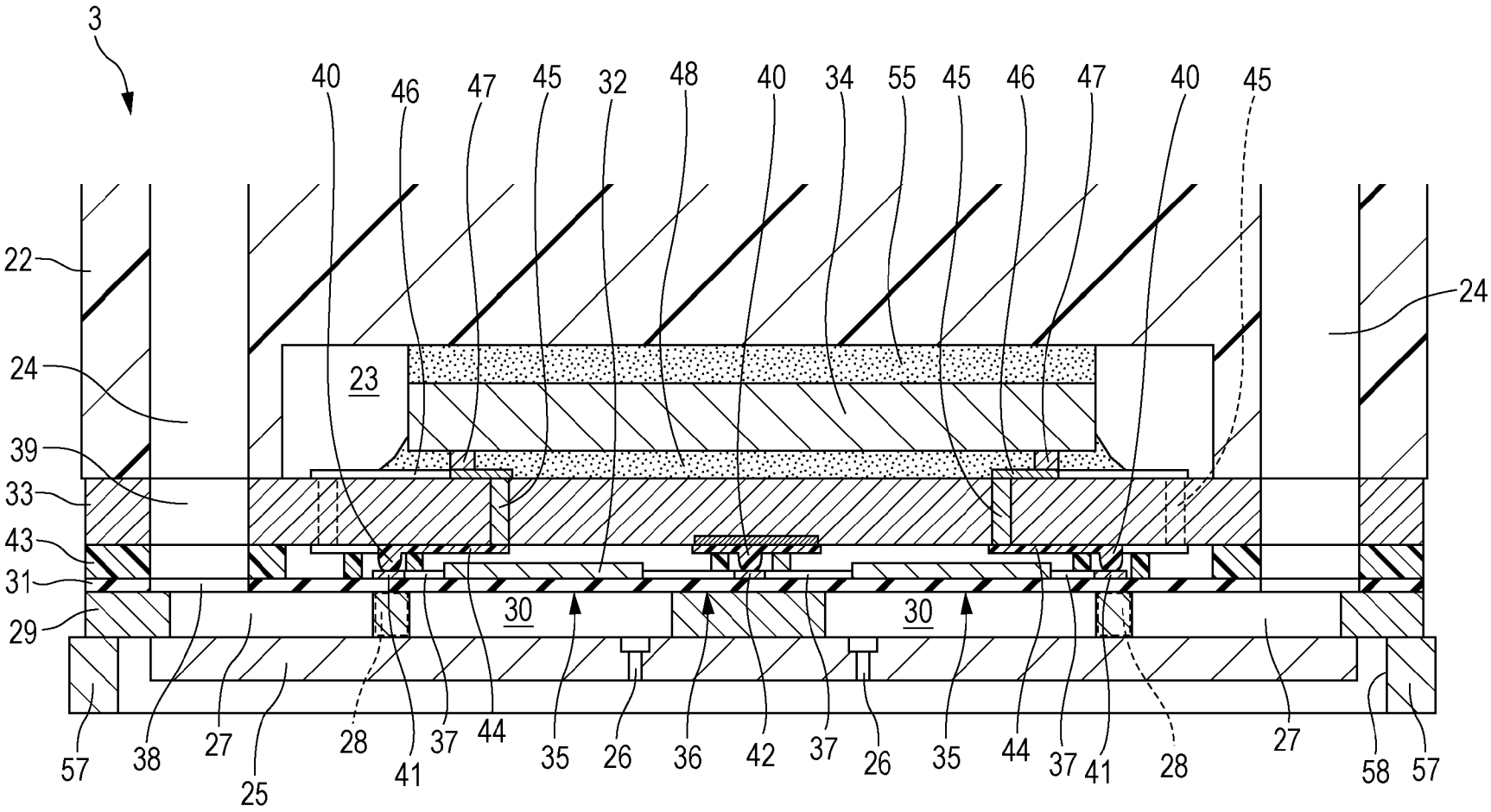
FIG. 11 is a cross-sectional view illustrating a configuration of a recording head in a fourth embodiment.

The recording head 3 in the fourth embodiment shown in FIG. 11 is different from the third embodiment described above in that a fixing plate 57 is connected thereto. The fixing plate 57 is, for example, a plate material formed of stainless steel (SUS), and protects the lower surface of the recording head 3. A fixed plate opening 58 for exposing the nozzle plate 25 of the recording head 3 is formed on the fixing plate 57. In the present embodiment, since the nozzle plate 25 is formed to be smaller than the pressure chamber-forming substrate 29, there is a region in the lower surface of the pressure chamber-forming substrate 29 where the outer peripheral region is separated from the nozzle plate 25 (that is, a region where the nozzle plate 25 is not connected). The fixing plate 57 is bonded to the outer peripheral region of the pressure chamber-forming substrate 29 by, for example, an adhesive or the like. That is, the fixing plate 57 is bonded at a position not overlapping with the nozzle plate 25. Since the configuration in other respects is the same as the third embodiment described above, description thereof will be omitted. In addition, as shown in FIG. 11, in a case where a gap is formed between the edge of the fixed plate opening 58 and the nozzle plate 25, it is also possible to fill the gap with an adhesive. Furthermore, it is also possible to form a recording head unit (a recording head in a broad sense) having a plurality of nozzle rows by attaching a plurality of recording heads to the fixing plate. In such a case, a plurality of fixed plate openings for exposing the nozzle plate of each recording head are formed on the fixing plate.

Figure 12:
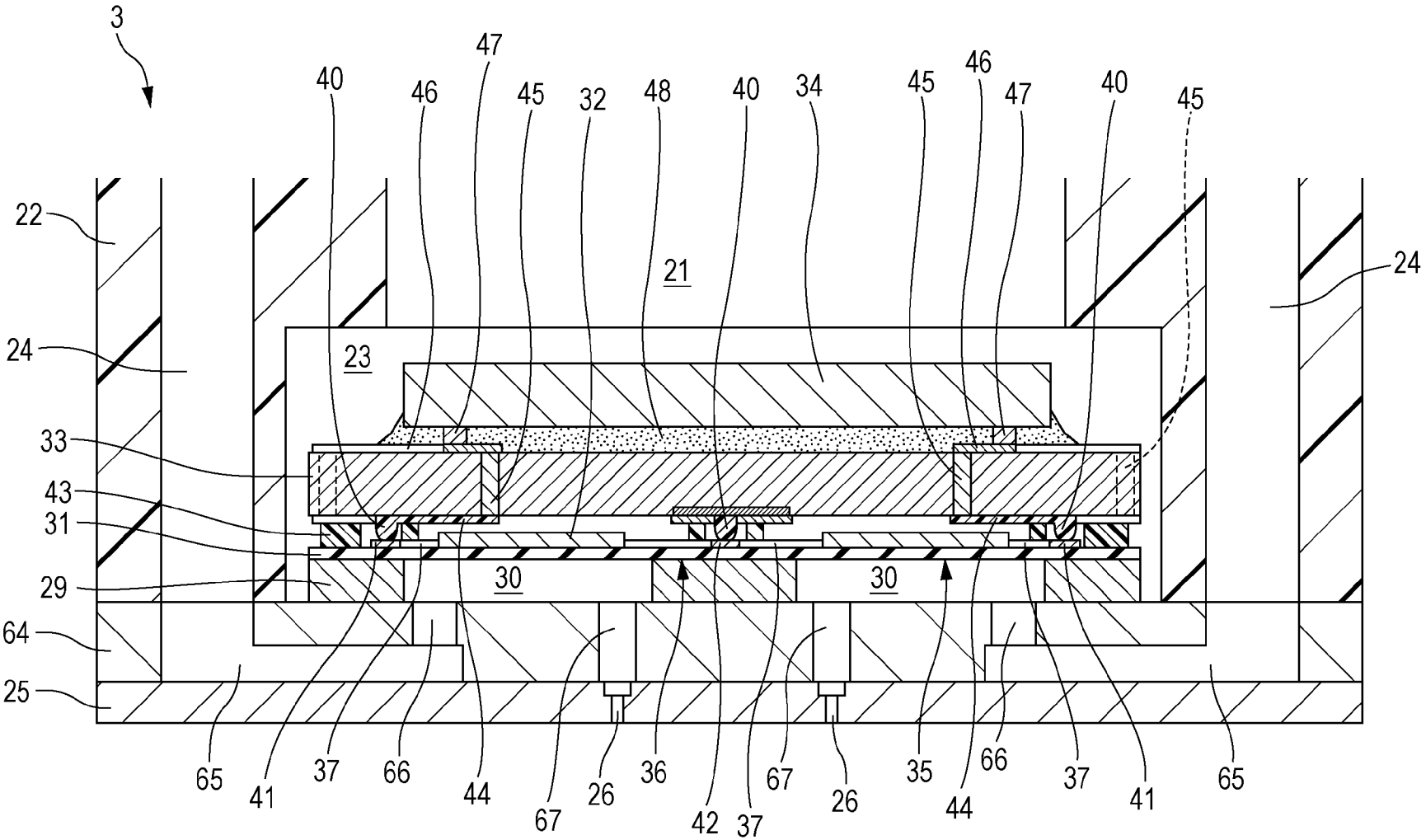
FIG. 12 is a cross-sectional view illustrating a configuration of a recording head according to a fifth embodiment.

The recording head 3 in the fifth embodiment shown in FIG. 12 has a communicating substrate 64 between the nozzle plate 25 and the pressure chamber-forming substrate 29, unlike the first to fourth embodiments. In addition, the pressure chamber-forming substrate 29, the vibrating plate 31, and the sealing plate 33 in the present embodiment are formed to be smaller than the accommodating space 23. Then, the pressure chamber-forming substrate 29, the vibrating plate 31, the sealing plate 33, and the driving IC 34 are accommodated in the accommodating space 23 in state of being a stacked into a unit. The communicating substrate 64 is a silicon substrate in which the pressure chamber-forming substrate 29 and the head case 22 are bonded to the upper surface and the nozzle plate 25 is bonded to the lower surface. When the communicating substrate 64 on which the pressure chamber-forming substrate 29, the vibrating plate 31, the sealing plate 33, and the driving IC 34 are stacked is bonded to the head case 22, the pressure chamber-forming substrate 29, the vibrating plate 31, the sealing plate 33, and the driving IC 34 are formed to be accommodated in the accommodating space 23.

In addition, as shown in FIG. 12, the communicating substrate 64 has a reservoir 65 communicating with the liquid introduction path 24 and storing ink common to each of the pressure chambers 30, a communication port 66 for individually supplying the ink to each of the pressure chambers 30 from the liquid introduction path 24 via the reservoir 65, and a nozzle communication path 67 for communicating the pressure chambers 30 and the nozzles 26, which are formed by etching or the like. The reservoir 65 is an elongated hollow portion along the nozzle row direction, and is formed in two rows corresponding to the rows of the pressure chambers 30 arranged in two rows in parallel. The communication port 66 is a flow path formed in a cross-sectional area narrower than the cross-sectional area of the pressure chamber 30 in the ink flowing direction. Through this communication port 66, it is possible to impart a constant flow path resistance to the ink passing through the communication port 28. A plurality of communication ports 66 and a plurality of nozzle communication paths 67 are formed along the nozzle row direction. In addition, the communication port 66 communicates with an end on one side (outer side) in the longitudinal direction (the direction orthogonal to the nozzle row direction) of the pressure chamber 30, and the nozzle communication path 67 communicates with an end on the other side (inner side) in the longitudinal direction of the pressure chamber 30. Since the configuration in other respects is the same as the first embodiment described above, description thereof will be omitted.

Figure 13:
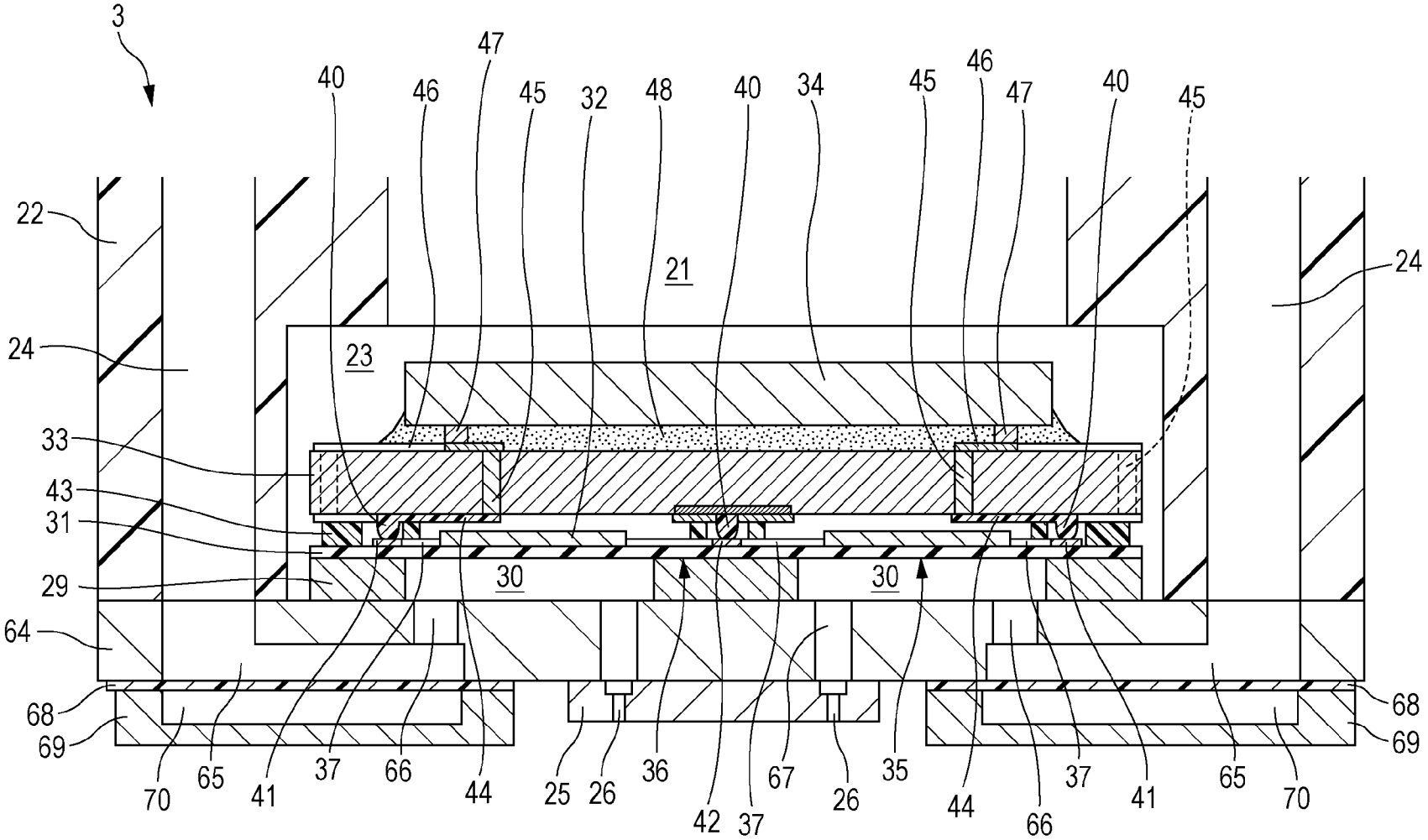
FIG. 13 is a cross-sectional view illustrating a configuration of a recording head in a sixth embodiment.

The recording head 3 according to the sixth embodiment shown in FIG. 13 is different from the fifth embodiment described above in the point that a compliance sheet 68 having flexibility and the protective substrate 69 for protecting the compliance sheet 68 are bonded to the lower surface of the communicating substrate 64. To provide a more specific description, the compliance sheet 68 is, for example, a thin film substrate formed of resin or the like, and is bonded to the lower surface of the communicating substrate 64. In addition, the protective substrate 69 is a rigid substrate formed of metal or the like, and is bonded to the lower surface of the compliance sheet 68. In the present embodiment, the compliance sheet 68 and the protective substrate 69 are bonded to the region corresponding to the reservoir 65 on the lower surface of the communicating substrate 64, while the nozzle plate 25 is bonded to a center region separated from the region corresponding to the reservoir 65 on the lower surface of the communicating substrate 64. That is, the compliance sheet 68 and the protective substrate 69 are bonded to the lower surface of the communicating substrate 64 at a position not overlapping with the nozzle plate 25. With such a configuration, the opening on the lower surface side of the space forming the reservoir 65 is sealed with the compliance sheet 68. In other words, the lower surface of the reservoir 65 is partitioned by the compliance sheet 68. As a result, the lower surface of the reservoir 65 functions as a compliance section which absorbs pressure fluctuations of the ink in the reservoir 65. The region of the protective substrate 69 corresponding to the reservoir 65 is provided with a recessed portion 70 recessed halfway in the thickness direction from the compliance sheet 68 side so as to not hinder the flexible deformation of the compliance sheet 68. In addition, since the configuration in other respects is the same as the fifth embodiment described above, description thereof will be omitted.

Figure 14:
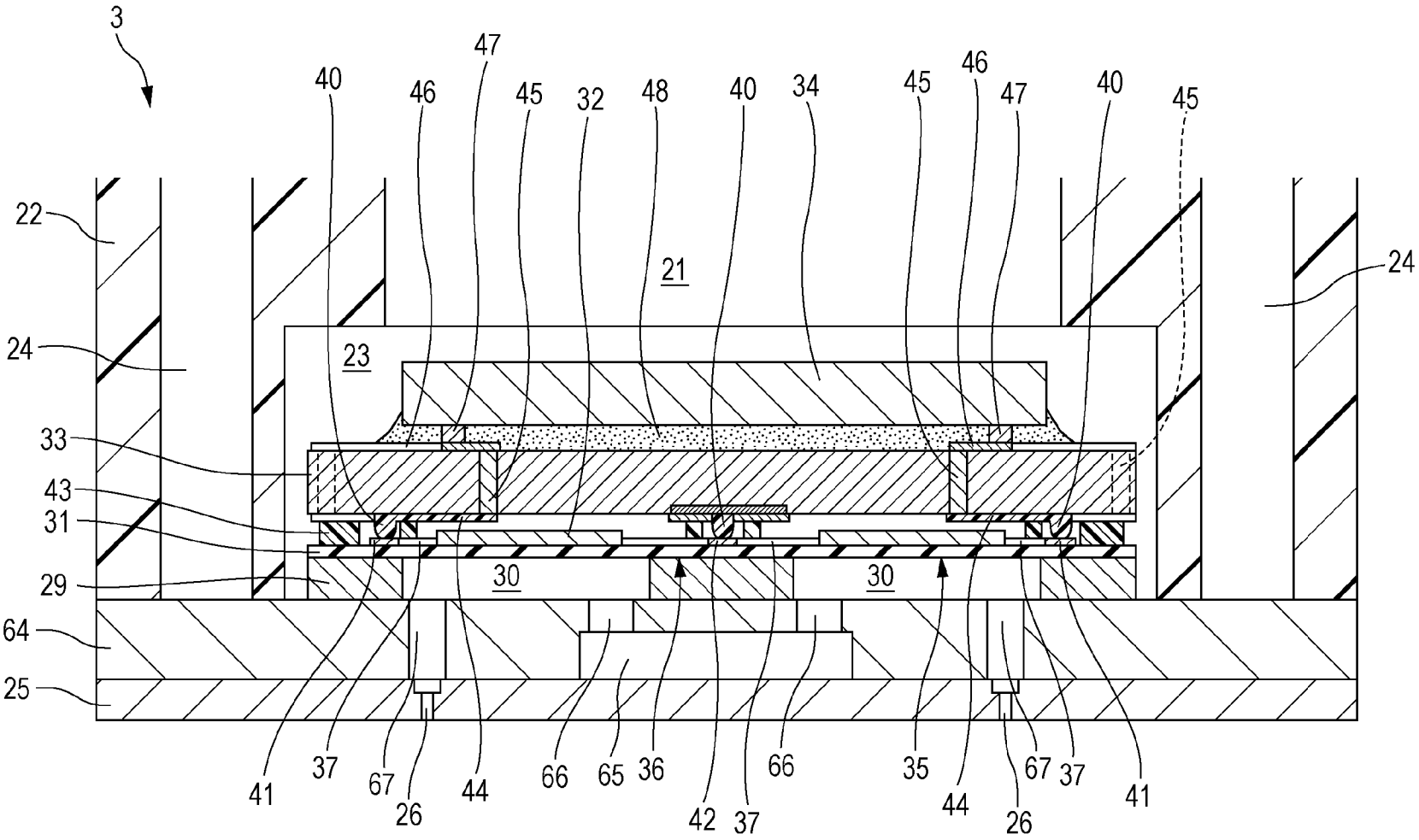
FIG. 14 is a cross-sectional view illustrating a configuration of a recording head in a seventh embodiment.

In the recording head 3 of the seventh embodiment shown in FIG. 14, the reservoir 65 is provided in a region corresponding to a region between one nozzle row and the other nozzle row. That is, one reservoir 65 is formed in the central portion of the communicating substrate 64 in the direction orthogonal to the nozzle row. In addition, in the present embodiment, ink is supplied from the reservoir 65 to both of the one row of the pressure chambers 30 and the other row of the pressure chambers 30. That is, ink common to the rows of the pressure chambers 30 on both sides is stored in the reservoir 65 in the present embodiment. The communication port 66 connecting the reservoir 65 and the pressure chamber 30 communicates with the end on the other side (inner side) of the pressure chamber 30 in the longitudinal direction (the direction orthogonal to the nozzle row direction), and the nozzle communication path 67 communicates with the end on the one side (outer side) in the longitudinal direction of the pressure chamber 30. Therefore, the interval between one nozzle row and the other nozzle row in the present embodiment tends to be wider than in the case of the first to sixth embodiments described above. In addition, the reservoir 65 extends to the outer side of the region where the nozzles 26 are formed in the nozzle row direction, and is connected to an ink flow path (not shown). This ink flow path is a flow path which is formed in the communicating substrate 64 or the head case 22 and which connects the liquid introduction path 24 and the reservoir 65. In the present embodiment, two ink flow paths are formed corresponding to the two liquid introduction paths 24. Ink from the liquid introduction paths 24 is introduced into the reservoir 65 via these ink flow paths. Also in the present embodiment, in the same manner as the sixth embodiment shown in FIG. 13, it is also possible to seal the reservoir with a flexible compliance sheet. That is, it is also possible to adopt a configuration in which the compliance sheet and the protective substrate are bonded to the region corresponding to the reservoir on the lower surface of the communicating substrate, and the nozzle plate is bonded to a region separated from the region corresponding to the reservoir on the lower surface of the communicating substrate. In addition, since the configuration in other respects is the same as the fifth embodiment described above, description thereof will be omitted.

In the fifth to seventh embodiments shown in FIG. 12 to FIG. 14, the head case is provided with a case opening and the driving IC 34 is configured in a state of being exposed to the case opening 21; however, the invention is not limited thereto. Also in the recording head 3 according to the fifth to seventh embodiments, in the same manner as the second embodiment shown in FIG. 9, it is also possible to adopt a configuration in which the case opening is not provided in the head case 22. That is, it is also possible to adopt a configuration in which the driving IC 34 is sealed in the accommodating space 23. Furthermore, in the recording head 3 according to the fifth to seventh embodiments, in the same manner as the third embodiment shown in FIG. 10, it is also possible to adopt a configuration in which the upper surface of the driving IC 34 and the ceiling surface of the accommodating space 23 are bonded with an adhesive.

In addition, in each of the embodiments described above, the recording head 3 provided with the driving IC 34 on the sealing plate 33 is exemplified; however, the invention is not limited thereto. For example, it is also possible to adopt a configuration in which a circuit forming a driving IC is formed on the sealing plate itself without providing a driving IC on the sealing plate. Alternatively, it is also possible to adopt a configuration in which a driving IC is bonded on the pressure chamber-forming substrate or the communicating substrate without forming wiring and circuits on the sealing plate.

Figure 15:
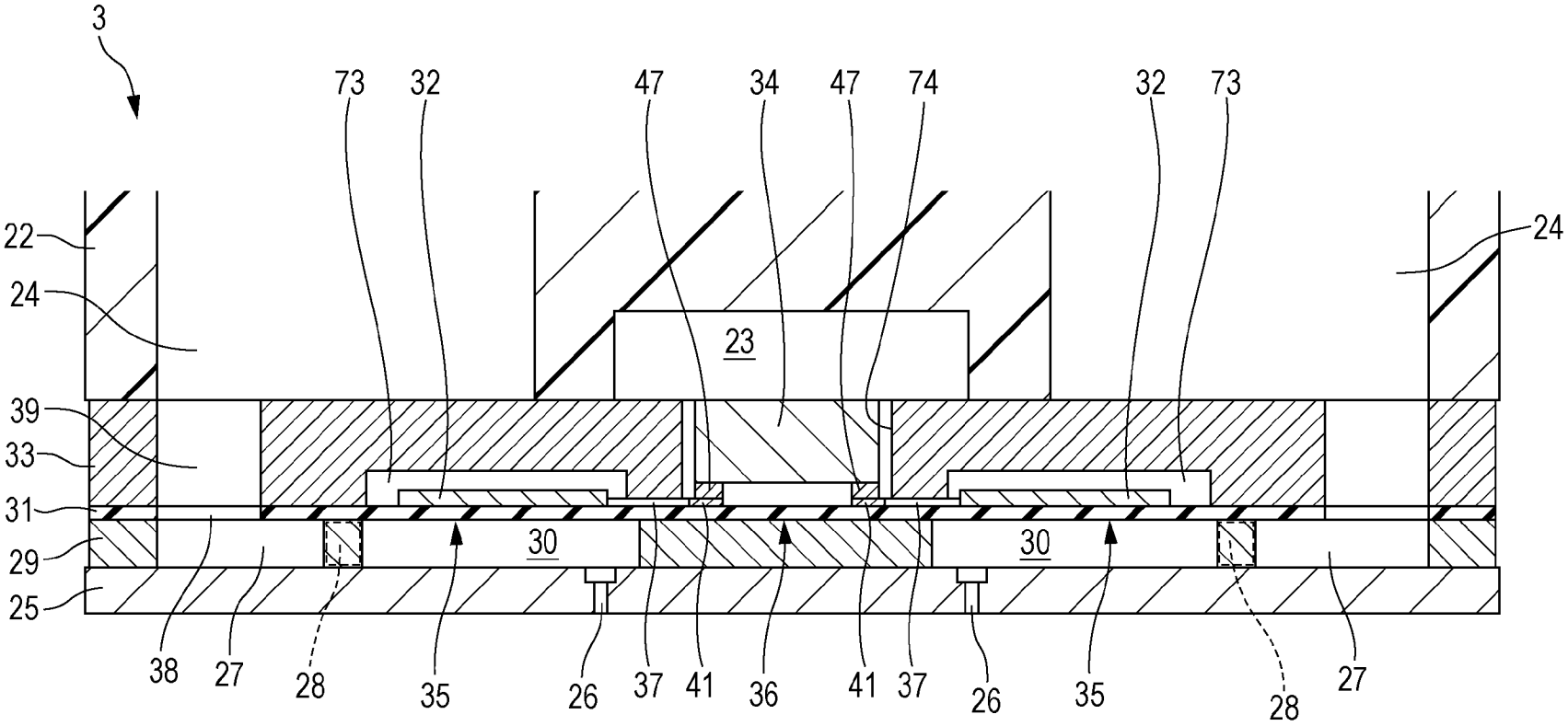
FIG. 15 is a cross-sectional view illustrating a configuration of a recording head in an eighth embodiment.

For example, in the recording head 3 of the eighth embodiment shown in FIG. 15, the driving IC 34 is not connected to the sealing plate 33, and wirings such as through wiring and bump electrodes are also not formed on the sealing plate 33. Specifically, the recording head 3 in the present embodiment does not have a communicating substrate as in the first embodiment, and is formed of the driving IC 34, the sealing plate 33, the pressure chamber-forming substrate 29, the nozzle plate 25, the head case 22, and the like. The sealing plate 33 and the driving IC 34 are bonded to the upper surface of the vibrating plate 31 stacked on the pressure chamber-forming substrate 29. In addition, the sealing plate 33 has formed therein a sealing plate opening 39 for connecting the reservoir 27 and the liquid introduction path 24, a piezoelectric element accommodating space 73 for accommodating the piezoelectric element 32, and an arrangement space 74 in which the driving IC 34 is arranged. The piezoelectric element accommodating space 73 is a recessed portion formed to a size that does not hinder the drive of the piezoelectric element 32 and is formed in two rows corresponding to the rows of the piezoelectric elements 32 formed in two rows. The arrangement space 74 is a space formed in a state penetrating in the substrate thickness direction in a region between the piezoelectric element accommodating spaces 73 formed in two rows. The arrangement space 74 in the present embodiment is formed in a region corresponding to the middle between one row of the pressure chambers 30 and the other row of the pressure chambers 30. Therefore, the driving IC 34 is arranged in the middle between the one row of the pressure chambers 30 and the other row of the pressure chambers 30.

In addition, as shown in FIG. 15, lead wiring 37 corresponding to the individual electrodes extend from the respective piezoelectric elements 32 toward the arrangement space 74. The lead wirings 37 corresponding to each individual electrode are connected to the individual terminal 41 formed in the arrangement space 74. As a result, the IC terminal 47 of the driving IC 34 and the corresponding individual terminal 41 are connected in the arrangement space 74. In addition, the accommodating space 23 of the head case 22 in the present embodiment is provided at a position facing the arrangement space 74 and communicates with the arrangement space 74. Furthermore, a case opening is not provided on the ceiling surface of the accommodating space 23. Therefore, the driving IC 34 is sealed in the space formed by the accommodating space 23 and the arrangement space 74. In addition, the upper surface of the driving IC 34 and the head case 22 (specifically, the ceiling surface of the accommodating space 23) are in a hollow state without contacting each other. As a result, also in the present embodiment, it is possible to efficiently transfer the heat generated by the driving IC 34 to the sealing plate 33 side. In addition, since the driving IC 34 in the present embodiment is arranged in the middle between the one row of the pressure chambers 30 and the other row of the pressure chambers 30, it is possible to evenly heat the one row of the pressure chambers 30 and the other row of the pressure chambers 30. Although the driving IC 34 in the present embodiment is accommodated in the arrangement space 74, it is also possible to adopt a configuration in which a portion of the driving IC protrudes from the arrangement space 74. That is, it is also possible to adopt a configuration in which a portion (upper portion) of the driving IC is accommodated in the accommodating space 23. In addition, the lead wiring 37 corresponding to the individual electrode corresponds to the wiring in the invention. Furthermore, since the configuration in other respects is the same as the first embodiment described above, description thereof will be omitted.

Figure 16:
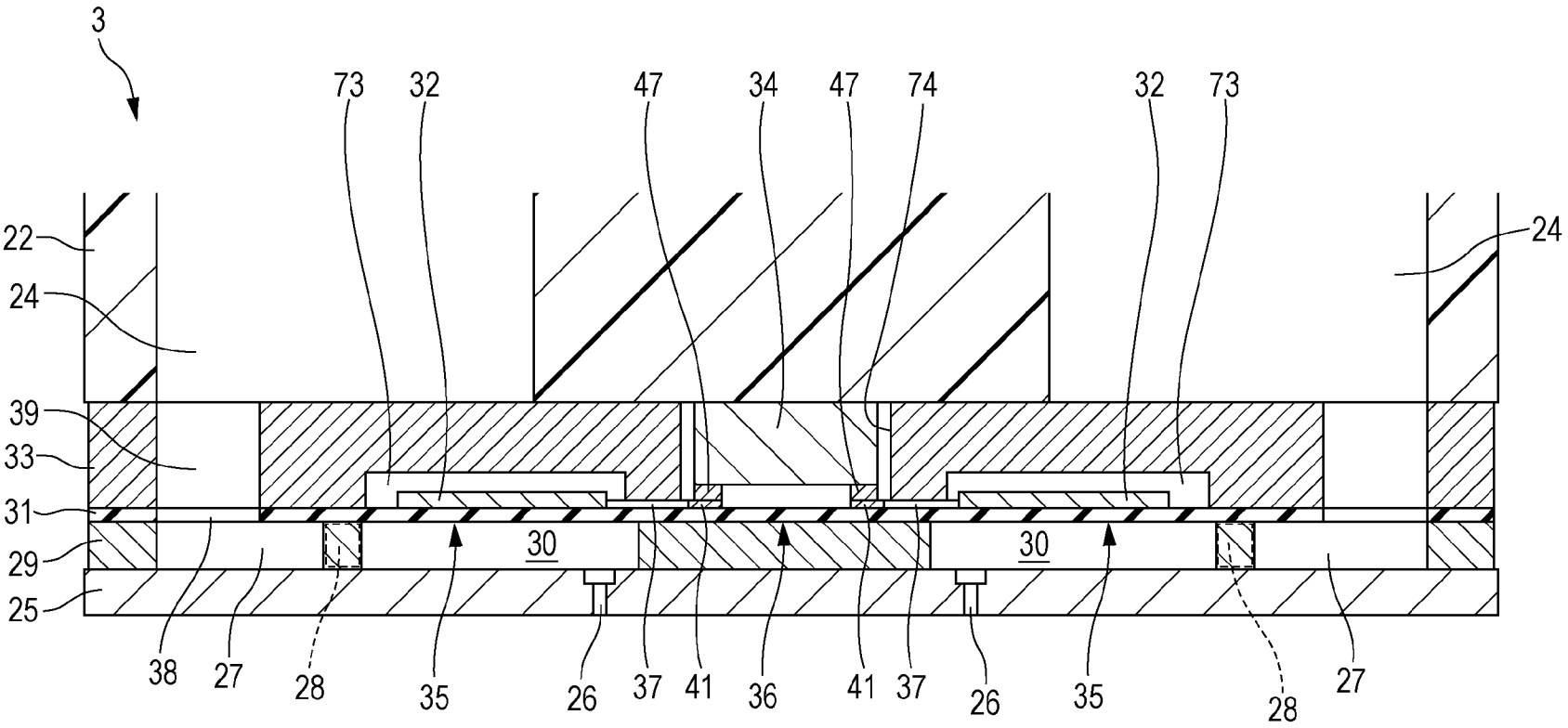
FIG. 16 is a cross-sectional view illustrating a configuration of a recording head in a ninth embodiment.

In addition, the recording head 3 in the ninth embodiment shown in FIG. 16 is different from the eighth embodiment described above in the point that an accommodating space is not formed in the head case 22. That is, the upper opening of the arrangement space 74 in the present embodiment is sealed by the lower surface of the head case 22. In the present embodiment, the upper surface of the driving IC 34 and the lower surface of the head case 22 are in contact with each other, but the invention is not limited thereto. For example, by adjusting the height of the driving IC 34, it is also possible to provide a gap between the upper surface of the driving IC 34 and the lower surface of the head case 22. In addition, it is also possible to fill an adhesive between the upper surface of the driving IC 34 and the lower surface of the head case 22. In this case, it is desirable to use an adhesive having a thermal conductivity lower than the thermal conductivity of the sealing plate 33. In this manner, it is possible to suppress the heat generated in the driving IC 34 from escaping to the head case 22 side. Since the configuration in other respects is the same as the eighth embodiment described above, description thereof will be omitted.

In each of the embodiments described above, one driving IC 34 is provided in the recording head 3, but the invention is not limited thereto. It is also possible to provide a plurality of driving ICs in the recording head. For example, it is possible to adopt a configuration in which a plurality of driving ICs are formed in parallel along the nozzle row direction. In each of the embodiments described above, elongated reservoirs are provided in two rows along the nozzle row direction, but the invention is not limited thereto. It is also possible to adopt a configuration in which one or both reservoirs are divided in the nozzle row direction. That is, it is also possible to adopt a configuration in which a plurality of reservoirs are lined up along the nozzle row direction. Furthermore, it is also possible to provide a temperature detection means such as a thermistor for measuring the temperature of the ink in the pressure chamber in the recording head. Doing so makes it possible to more accurately determine the temperature of the ink in the pressure chamber in each step of the maintenance operation and the printing operation. In addition, in each of the embodiments described above, the driving signal COM including the non-ejection pulse Pn is applied to the piezoelectric element 32 to minutely vibrate the ink in the pressure chamber 30 to such an extent that ink is not ejected from the nozzle 26; however, a configuration in which the ink is slightly ejected from the nozzle 26 as a result is not excluded.

In the above description, the ink jet recording head 3 is described as an example of the liquid ejecting head, but the invention is also able to be applied to other liquid ejecting heads. For example, it is also possible to apply the invention to a color material ejecting head used for manufacturing a color filter such as a liquid crystal display, an electrode material ejecting head used for forming an electrode of an organic electroluminescence (EL) display, a field emission display (FED), and the like, a bioorganic material ejecting head used for production of a biochip (a biochemical element), and the like. In the color material ejecting head for the display manufacturing apparatus, solutions of the respective color materials of R (Red), G (Green) and B (Blue) are ejected as one type of liquid. In addition, in the electrode material ejecting head for the electrode forming apparatus, a liquid electrode material is ejected as one type of liquid, and in a bioorganic material ejecting head for a chip manufacturing apparatus, a solution of bioorganic material is ejected as one type of liquid.

What is claimed is:

1. A liquid ejecting head comprising:

a pressure chamber-forming substrate provided with a pressure chamber;

a nozzle communicating with the pressure chamber;

a piezoelectric element which is provided in a vibrating plate closing a portion of the pressure chamber and which generates pressure fluctuations in a liquid in the pressure chamber by causing the vibrating plate to vibrate; and a driving IC which is connected to the piezoelectric element through wiring and which carries out driving control of the piezoelectric element, wherein the driving control has a first preliminary heating step of heating the liquid in the pressure chamber by causing at least any one of the piezoelectric element, the driving IC, and the wiring to generate heat;

a preliminary ejection step of ejecting the liquid in the pressure chamber from the nozzle after the first preliminary heating step;

a second preliminary heating step of heating the liquid in the pressure chamber more weakly than in the first preliminary heating step by causing at least any one of the piezoelectric element, the driving IC, and the wiring to generate heat after the preliminary ejection step; and a main ejection step of starting an operation of ejecting the liquid from the nozzle after the second preliminary heating step.

2. The liquid ejecting head according to claim 1, wherein in at least one step of the first preliminary heating step or the second preliminary heating step, a driving voltage waveform which causes pressure fluctuations in the liquid in the pressure chamber to such an extent that liquid is not ejected from the nozzle is applied to the piezoelectric element to cause at least any one of the piezoelectric element, the driving IC, and the wiring to generate heat.

3. The liquid ejecting head according to claim 2, further comprising:

a plurality of the pressure chambers, the nozzles, and the piezoelectric elements, wherein, in at least one step of the first preliminary heating step or the second preliminary heating step, the driving IC applies the driving voltage waveform to at least one of the piezoelectric elements.

4. A liquid ejecting apparatus comprising:

the liquid ejecting head according to claim 3.

5. The liquid ejecting head according to claim 2, wherein, in the second preliminary heating step, the driving voltage waveform applied to the piezoelectric element is the same as the driving voltage waveform applied to the piezoelectric element corresponding to the nozzle from which the liquid is not ejected in a printing operation.

6. A liquid ejecting apparatus comprising:

the liquid ejecting head according to claim 5.

7. The liquid ejecting head according to claim 2, further comprising:

a plurality of the pressure chambers, the nozzles, and the piezoelectric elements, wherein, in the first preliminary heating step, the preliminary ejection step, and the second preliminary heating step, the same driving voltage waveform is applied to the piezoelectric elements corresponding to the nozzles which eject the same type of liquid among the plurality of piezoelectric elements.

8. A liquid ejecting apparatus comprising:

the liquid ejecting head according to claim 7.

9. A liquid ejecting apparatus comprising:

the liquid ejecting head according to claim 2.

10. The liquid ejecting head according to claim 1, wherein the driving IC overlaps at least a portion of the pressure chamber in a stacking direction of the pressure chamber-forming substrate and the piezoelectric element.

11. A liquid ejecting apparatus comprising:

the liquid ejecting head according to claim 10.

12. The liquid ejecting head according to claim 1, further comprising:

a reservoir in which a liquid is stored, wherein the reservoir and the pressure chamber communicate with each other via a communication port.

13. A liquid ejecting apparatus comprising:

the liquid ejecting head according to claim 12.

14. The liquid ejecting head according to claim 1, further comprising:

a plurality of the pressure chambers, the nozzles, and the piezoelectric elements, a plurality of pressure chamber groups provided with a plurality of the pressure chambers arranged linearly, wherein the driving IC is arranged over a position overlapping at least a portion of another pressure chamber group in the stacking direction from a position overlapping at least a portion of one pressure chamber group in a stacking direction of the pressure chamber-forming substrate and the piezoelectric element.

15. A liquid ejecting apparatus comprising:

the liquid ejecting head according to claim 14.

16. The liquid ejecting head according to claim 1, further comprising:

a plurality of the pressure chambers, the nozzles, the piezoelectric elements, and reservoirs communicating with the plurality of the pressure chambers, wherein, in a plurality of pressure chambers communicating with the same reservoir among the plurality of pressure chambers, liquid amounts ejected from the corresponding nozzles are set in the respective preliminary ejection steps.

17. A liquid ejecting apparatus comprising:

the liquid ejecting head according to claim 16.

18. The liquid ejecting head according to claim 1, wherein the driving IC is provided with a switching circuit, and the driving IC is caused to generate heat by switching the switching circuit on and off in at least one step of the first preliminary heating step or the second preliminary heating step.

19. The liquid ejecting head according to claim 1, further comprising:

an operation mode consisting of a third preliminary heating step of heating the liquid in the pressure chamber by causing at least any one of the piezoelectric element, the driving IC, and the wiring to generate heat under conditions in which the first preliminary heating step and the preliminary ejection step are not carried out and liquid is not ejected from the nozzle, and a main ejection step of starting an operation which ejects the liquid from the nozzles after the third preliminary heating step.

20. A liquid ejecting apparatus comprising:

the liquid ejecting head according to claim 1.

* * * * *